US009347275B2

(12) United States Patent
Azar et al.

(10) Patent No.: US 9,347,275 B2
(45) Date of Patent: May 24, 2016

(54) FIXED CUTTER DRILL BIT WITH CORE FRAGMENTATION FEATURE

(75) Inventors: Michael G. Azar, The Woodlands, TX (US); Hemachandar Mada, Houston, TX (US)

(73) Assignee: Smith International, Inc., Houston, TX (US)

( * ) Notice: Subject to any disclaimer, the term of this patent is extended or adjusted under 35 U.S.C. 154(b) by 572 days.

(21) Appl. No.: 13/528,518

(22) Filed: Jun. 20, 2012

(65) Prior Publication Data

US 2013/0020134 A1 Jan. 24, 2013

Related U.S. Application Data

(60) Provisional application No. 61/499,851, filed on Jun. 22, 2011, provisional application No. 61/609,527, filed on Mar. 12, 2012.

(51) Int. Cl.
*E21B 10/04* (2006.01)
*E21B 10/48* (2006.01)

(52) U.S. Cl.
CPC ..... *E21B 10/485* (2013.01); *E21B 10/04* (2013.01)

(58) Field of Classification Search
CPC ..... E21B 10/02; E21B 10/04; E21B 10/43; E21B 10/485
USPC ..... 175/332, 333, 403, 404
See application file for complete search history.

(56) References Cited

U.S. PATENT DOCUMENTS 2,931,630 A * 4/1960 Grady ..... 175/405.1
2,941,241 A 6/1960 Strong
2,941,248 A 6/1960 Hall
2,947,611 A 8/1960 Bundy
3,609,818 A 10/1971 Wentorf
3,767,371 A 10/1973 Wentorf, Jr. et al.

(Continued)

FOREIGN PATENT DOCUMENTS

BE 1014561 A3 12/2003
CN 2227191 Y 5/1996

(Continued)

OTHER PUBLICATIONS

International Preliminary Report on Patentability and Written Opinon issued in corresponding International Application No. PCT/US2012/043305 mailed Jan. 9, 2014 (5 pages).

(Continued)

*Primary Examiner* — Robert E Fuller
*Assistant Examiner* — David Carroll

(57) ABSTRACT

A drill bit has a plurality of blades that include a coring blade, a plurality of flow courses that include an evacuation slot disposed between the plurality of blades, and a conical insert disposed on or proximate a bit centerline of the drill bit. Coring blade includes a first cutting element disposed at a first radial position from the bit centerline. Also, coring blade includes a substantially vertical surface and an angled surface. During drilling, first cutting element cuts formation to generate a core sample fragment at bit centerline. Core sample fragment is then broken away from formation using angled surface or conical insert after core sample fragment reaches a certain length. Core sample fragment then exits drill bit via an evacuation slot, from where core sample fragment is transported via an annulus to the surface of formation for testing and analysis.

34 Claims, 21 Drawing Sheets

(56) References Cited

U.S. PATENT DOCUMENTS

| | | | | |
|---|---|---|---|---|
| 4,104,344 | A | 8/1978 | Pope et al. | |
| 4,224,380 | A | 9/1980 | Bovenkerk et al. | |
| 4,288,248 | A | 9/1981 | Bovenkerk et al. | |
| 4,289,503 | A | 9/1981 | Corrigan | |
| 4,525,178 | A | 6/1985 | Hall | |
| 4,640,374 | A | 2/1987 | Dennis | |
| 4,673,414 | A | 6/1987 | Lavens et al. | |
| 4,694,918 | A | 9/1987 | Hall | |
| 4,882,128 | A | 11/1989 | Hukvari et al. | |
| 4,933,529 | A | 6/1990 | Saville | |
| 4,954,139 | A | 9/1990 | Cerutti | |
| 5,369,034 | A | 11/1994 | Hargett et al. | |
| 5,370,195 | A | 12/1994 | Keshavan et al. | |
| 5,582,261 | A | 12/1996 | Keith et al. | |
| 5,655,614 | A * | 8/1997 | Azar | 175/404 |
| 5,695,019 | A | 12/1997 | Shamburger, Jr. | |
| 6,283,233 | B1 | 9/2001 | Lamine et al. | |
| 6,332,503 | B1 | 12/2001 | Pessier et al. | |
| 6,394,202 | B2 | 5/2002 | Truax et al. | |
| 6,440,224 | B1 | 8/2002 | Wei et al. | |
| 6,744,024 | B1 | 6/2004 | Hayes et al. | |
| 7,703,559 | B2 | 4/2010 | Shen et al. | |
| 7,748,475 | B2 | 7/2010 | McClain et al. | |
| 7,757,789 | B2 | 7/2010 | Yong et al. | |
| 7,845,438 | B1 | 12/2010 | Vail et al. | |
| 7,992,658 | B2 | 8/2011 | Buske | |
| 8,887,837 | B2 | 11/2014 | Azar et al. | |
| 2004/0094334 | A1 | 5/2004 | Singh | |
| 2006/0011388 | A1 | 1/2006 | Boudrare et al. | |
| 2006/0081402 | A1 | 4/2006 | Lockwood et al. | |
| 2007/0114071 | A1 | 5/2007 | Hall | |
| 2007/0221406 | A1 | 9/2007 | Hall et al. | |
| 2008/0017421 | A1 | 1/2008 | Lockwood | |
| 2008/0029312 | A1 | 2/2008 | Hall et al. | |
| 2008/0035380 | A1 | 2/2008 | Hall et al. | |
| 2008/0035387 | A1 | 2/2008 | Hall et al. | |
| 2008/0099251 | A1 | 5/2008 | Hall et al. | |
| 2008/0173482 | A1 | 7/2008 | Hall et al. | |
| 2008/0185189 | A1 | 8/2008 | Griffo et al. | |
| 2008/0223623 | A1 | 9/2008 | Keshavan et al. | |
| 2008/0282618 | A1 | 11/2008 | Lockwood | |
| 2008/0314647 | A1 | 12/2008 | Hall et al. | |
| 2009/0120008 | A1 | 5/2009 | Lockwood et al. | |
| 2009/0139150 | A1 | 6/2009 | Ras | |
| 2009/0145663 | A1 | 6/2009 | Durairajan et al. | |
| 2009/0145669 | A1 | 6/2009 | Durairajan et al. | |
| 2009/0152018 | A1 | 6/2009 | Sani | |
| 2010/0018780 | A1 | 1/2010 | Johnson et al. | |
| 2010/0059288 | A1 | 3/2010 | Hall et al. | |
| 2010/0065332 | A1 | 3/2010 | Hall et al. | |
| 2010/0065338 | A1 | 3/2010 | Hall et al. | |
| 2010/0065339 | A1 | 3/2010 | Hall et al. | |
| 2010/0071964 | A1 | 3/2010 | Hall et al. | |
| 2010/0089648 | A1 | 4/2010 | Hall et al. | |
| 2010/0101870 | A1 | 4/2010 | Shamburger | |
| 2010/0122013 | A1 | 5/2010 | Klaiber et al. | |
| 2010/0133013 | A1 * | 6/2010 | Hahati et al. | 175/61 |
| 2010/0218999 | A1 | 9/2010 | Jones et al. | |
| 2010/0219001 | A1 | 9/2010 | Shen et al. | |
| 2010/0276145 | A1 | 11/2010 | Dewey et al. | |
| 2010/0300673 | A1 | 12/2010 | Richert et al. | |
| 2010/0314176 | A1 | 12/2010 | Zhang et al. | |
| 2011/0048811 | A1 | 3/2011 | Hall et al. | |
| 2011/0114392 | A1 * | 5/2011 | Dykstra et al. | 175/428 |
| 2011/0192651 | A1 | 8/2011 | Lyons et al. | |
| 2011/0192653 | A1 | 8/2011 | Stowe | |
| 2011/0259650 | A1 | 10/2011 | Hall et al. | |
| 2011/0297454 | A1 | 12/2011 | Shen et al. | |
| 2012/0031674 | A1 | 2/2012 | Lyons | |
| 2012/0205163 | A1 | 8/2012 | Azar et al. | |
| 2012/0234610 | A1 | 9/2012 | Azar et al. | |
| 2012/0273280 | A1 | 11/2012 | Zhang et al. | |
| 2012/0273281 | A1 | 11/2012 | Burhan et al. | |

FOREIGN PATENT DOCUMENTS

| | | | |
|---|---|---|---|
| CN | 201269049 | Y | 7/2009 |
| CN | 101611211 | A | 12/2009 |
| EP | 0087283 | A1 | 8/1983 |
| EP | 0874128 | A2 | 10/1998 |
| JP | 59123772 | A | 7/1984 |
| JP | 11264088 | A | 9/1999 |
| RU | 2087666 | C1 | 8/1997 |
| RU | 2360096 | C1 | 6/2009 |
| RU | 2008115275 | A | 10/2009 |
| RU | 2009125622 | A | 1/2011 |
| SU | 1495427 | A1 | 7/1989 |
| SU | 1747668 | A1 | 7/1992 |
| WO | WO 2008149240 | A2 * | 12/2008 |

OTHER PUBLICATIONS

International Search Report and Written Opinon issued in corresponding International Application No. PCT/US2012/043305 dated Dec. 6, 2012 (8 pages).

International Search Report and Written Opinion issued in corresponding International Application No. PCT/US2012/024606 dated May 17, 2012 (8 pages).

International Search Report and Written Opinion issued in corresponding International Application No. PCT/US2012/024609 dated May 17, 2012 (7 pages).

Office Action issued in related U.S. Appl. No. 13/826,193; Dated Nov. 25, 2013 (21 pages).

Notice of Allowance issued in related U.S. Appl. No. 13/826,193; Dated Apr. 1, 2014 (11 pages).

Notice of Allowance issued in related U.S. Appl. No. 13/826,193; Dated Jul. 7, 2014 (9 pages).

Examiner's Report issued in Canadian Application No. 2826939; Dated Aug. 21, 2014 (3 pages).

Examiner's Report issued in corresponding Canadian Application No. 2,827,116; Dated Oct. 16, 2014 (3 pages).

Office Action issued in corresponding Chinese Application No. 201280008571.9, mailed Mar. 23, 2015 (16 pages).

Non-Final Office Action issued in related U.S. Appl. No. 13/370,862, mailed May 1, 2015 (52 pages).

Non-Final Office Action issued in related U.S. Appl. No. 13/370,734, mailed May 6, 2015 (12 pages).

Office Action issued in Chinese Application No. 201280040733.7; Dated May 6, 2015 (25 pages).

Office Action issued in Chinese Application No. CN201280008587.X on May 6, 2015, 17 pages.

Search and Examination Report issued in British Application No. GB0918411.0 on Mar. 11, 2010, 7 pages.

Examination Report issued in British Application No. GB0918411.0 on Oct. 22, 2010; 3 pages.

Examiner's Report issued in Canadian Application No. CA2826939 on Oct. 20, 2015; 4 pages.

International Preliminary Report on Patentability in International Application No. PCT/US2012/024606 on Aug. 22, 2013, 7 pages.

International Preliminary Report on Patentability in International Application No. PCT/US2012/024609 on Aug. 22, 2013, 6 pages.

Non-Final Rejection issued in U.S. Appl. No. 13/826,193 on Nov. 25, 2013, 7 pages.

Non-Final Rejection issued in U.S. Appl. No. 13/370,862 on May 1, 2015, 6 pages.

Non-Final Rejection issued in U.S. Appl. No. 13/370,862 on Sep. 30, 2015, 6 pages.

Decision on Grant issued in Russian Patent Appl. No. 2014101693 received Mar. 11, 2016; 20 pages.

* cited by examiner

FIXED CUTTER DRILL BIT WITH CORE FRAGMENTATION FEATURE

CROSS-REFERENCE TO RELATED APPLICATIONS

This application claims the benefit of U.S. Provisional Application 61/499,851 filed on Jun. 22, 2011, and 61/609,527 filed on Mar. 12, 2012, both of which are herein incorporated by reference in their entirety.

BACKGROUND

1. Field

Embodiments disclosed herein generally relate to apparatus and methods for obtaining core sample fragments from a subterranean formation. More specifically, embodiments disclosed herein relate to fixed cutter drill bits for obtaining core sample fragments from a subterranean formation.

2. Background Art

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element comprises an elongate and generally cylindrical tungsten carbide substrate that is received and secured in a pocket formed in the surface of one of the blades. The cutting elements typically include a hard cutting layer of polycrystalline diamond (PCD) or other superabrasive materials such as thermally stable diamond or polycrystalline cubic boron nitride. These cutting elements are designed to shear formations that range from soft to medium hard. For convenience, as used herein, reference to "PDC bit" or "PDC cutters" refers to a fixed cutter bit or cutting element employing a hard cutting layer of polycrystalline diamond or other superabrasive materials.

Referring to FIGS. 1 and 2, a conventional PDC bit 10 adapted for drilling through formations of rock to form a borehole is shown. PDC bit 10 generally includes a bit body 12, a shank 13, and a threaded connection or pin 14 for connecting the PDC bit 10 to a drill string (not shown) that is employed to rotate the bit in order to drill the borehole. Bit face 20 supports a cutting structure 15 and is formed on the end of the PDC bit 10 that is opposite pin end 16. PDC bit 10 further includes a central axis 11 about which PDC bit 10 rotates in the cutting direction represented by arrow 18.

Cutting structure 15 is provided on face 20 of PDC bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of PDC bit 10. However, secondary blades 34, 35, 36 extend radially along bit face 20 from a position that is distal bit axis 11 toward the periphery of PDC bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip 44*a* furthest from blade tops 42, 52 to which cutting element 40 is mounted.

Referring now to FIG. 3, a profile of PDC bit 10 is shown as it would appear with all blades (e.g., primary blades 31, 32, 33 and secondary blades 34, 35, 36) and cutting faces 44 of all cutting elements 40 rotated into a single rotated profile. In rotated profile view, blade tops 42, 52 of all blades 31-36 of PDC bit 10 form and define a combined or composite blade profile 39 that extends radially from bit axis 11 to outer radius 23 of PDC bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

Conventional composite blade profile 39 (most clearly shown in the right half of PDC bit 10 in FIG. 3) may generally be divided into three regions conventionally labeled cone region 24, shoulder region 25, and gage region 26. Cone region 24 comprises the radially innermost region of PDC bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional PDC bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., PDC bit 10), the composite blade profile includes only one convex shoulder region (e.g., convex shoulder region 25), and only one blade profile nose (e.g., nose 27). As shown in FIGS. 1-3, cutting elements 40 are arranged in rows along blades 31-36 and are positioned along the bit face 20 in the regions previously described as cone region 24, shoulder region 25 and gage region 26 of composite blade profile 39. In particular, cutting elements 40 are mounted on blades 31-36 in predetermined radially-spaced positions relative to the central axis 11 of the PDC bit 10.

For drilling harder formations, the mechanism for drilling changes from shearing to abrasion. For abrasive drilling, bits having fixed, abrasive elements are preferred. While PDC bits are known to be effective for drilling some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material (e.g., metal-matrix composites) to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

An example of a prior art diamond impregnated drill bit is shown in FIG. 4. The impregnated bit 70 includes a bit body 72 and a plurality of ribs 74 that are formed in the bit body 72. Ribs 74 may extend from a center of the bit body radially outward to the outer diameter of the bit body 72, and then axially downward, to define the diameter (or gage) of the impregnated bit 70. The ribs 74 are separated by channels 76 that enable drilling fluid to flow between and both clean and cool the ribs 74. The ribs 74 are typically arranged in groups 79 where a gap 78 between groups 79 is typically formed by removing or omitting at least a portion of a rib 74. The gaps 78, which may be referred to as "fluid courses," are positioned to provide additional flow channels for drilling fluid and to provide a passage for formation cuttings to travel past the drill bit 70 toward the surface of a wellbore (not shown).

Referring now to FIG. 5, an example of a prior art impregnated bit 80 in accordance with U.S. Pat. No. 6,394,202, which is assigned to the assignee of the present invention and is hereby incorporated by reference, is shown. In FIG. 5, the impregnated bit 80 comprises a shank 82 and a crown 84. Shank 82 is typically formed of steel and includes a threaded pin 86 for attachment to a drill string. Crown 84 has a cutting face 88 and outer side surface 89. According to one or more embodiments, crown 84 is formed by infiltrating a mass of tungsten-carbide powder impregnated with synthetic or natural diamond.

Crown 84 may include various surface features, such as raised ribs 74. Preferably, formers are included during the manufacturing process so that the infiltrated, diamond-impregnated crown includes a plurality of holes or sockets 85 that are sized and shaped to receive a corresponding plurality of diamond-impregnated inserts 83. Once crown 84 is formed, inserts 83 are mounted in the sockets 85 and affixed by any suitable method, such as brazing, adhesive, mechanical means such as interference fit, or the like. As shown in FIG. 5, the sockets 85 can be substantially perpendicular to the surface of the crown 84. Alternatively, and as shown in FIG. 5, sockets 85 can each be substantially perpendicular to the surface of the crown 84. In this embodiment, the sockets 85 are inclined such that inserts 83 are oriented substantially in the direction of rotation of the bit, so as to enhance cutting.

Referring now to FIG. 6, an example of a cross-sectional view of a rib of a prior art impregnated drill bit is shown. The rib 74 has a profile 90 defining its general shape/geometry that may be divided into various segments: a cone region 92 (recessed central area), a nose region 94 (leading cutting edge of profile), a shoulder region 96 (beginning of outside diameter of bit), transition region 98 (transition between shoulder and vertical gage), and a gage region 99 (vertical region defining outer diameter of bit). The primary cutting portion of the rib 74 includes cone region 92, nose region 94, and shoulder region 96, whereas gage region 99 is primarily responsible for maintaining the hole size.

Without regard to the type of bit, the cost of drilling a borehole is proportional to the length of time it takes to drill the borehole to the desired depth and location. The drilling time, in turn, is greatly affected by the number of times the drill bit must be changed in order to reach the targeted formation. This is the case because each time the bit is changed, the entire drill string, which may be miles long, must be retrieved from the borehole section by section. Once the drill string has been retrieved and the new bit installed, the bit must be lowered to the bottom of the borehole on the drill string, which again must be constructed section by section. This process, known as a "trip" of the drill string, requires considerable time, effort, and expense. Accordingly, it is always desirable to employ drill bits that will drill faster and longer and that are usable over a wider range of differing formation hardnesses and applications.

The length of time that a drill bit may be employed before it must be changed depends upon its rate of penetration ("ROP"), as well as its durability or ability to maintain a high or acceptable ROP. Specifically, ROP is the rate that a drill bit penetrates a given subterranean formation. ROP is typically measured in feet per hour. There is an ongoing effort to optimize the design of drill bits to more rapidly drill specific formations so as to reduce drilling costs, which are significantly affected by ROP.

Once a desired formation is reached in the borehole, a core sample of the formation may be extracted for analysis. Conventionally, a hollow coring bit is employed to extract a core sample from the formation. Once the core sample has been transported from the borehole to the surface, the sample may be used to analyze and test, for example, permeability, porosity, composition, or other geological properties of the formation.

Regardless of the type of drill bit employed to drill the formation, conventional coring methods require retrieval of the drill string from the borehole, replacement of the drill bit with a coring bit, and lowering of the coring bit into the borehole on the drill string in order to retrieve a core sample, which is then taken along the path of the borehole to reach the surface for analysis. That is, conventional coring methods require tripping the drill string, and thus require considerable time, effort, and expense.

Accordingly, there is a need for fixed cutter drill bits that are capable of extracting core sample fragments from a formation during drilling, thereby avoiding tripping the drill string and reducing coring costs. Further, it is desirable for such fixed cutter drill bits to maintain acceptable ROPs for acceptable lengths of time and to avoid bit plugging when core sample fragments are extracted for surface analysis.

SUMMARY

In one aspect, embodiments disclosed herein relate to a drill bit for obtaining core sample fragments from a subterranean formation that includes: a bit body having a bit centerline and a bit face; a plurality of blades extending radially along the bit face and separated by a plurality of flow courses therebetween, wherein one of the plurality of blades is a coring blade including: a substantially vertical surface; and an angled surface, wherein the substantially vertical surface and the angled surface are integrally connected; and a plurality of cutting elements disposed on the plurality of blades, wherein one of the plurality of cutting elements is a first cutting element disposed on the coring blade at a first radial position from the bit centerline.

In another aspect, embodiments disclosed herein relate to a drill bit for obtaining core sample fragments from a subterranean formation that includes: a bit body having a bit centerline and a bit face; a plurality of blades extending radially along the bit face and separated by a plurality of flow courses therebetween, wherein one of the plurality of blades is a coring blade, wherein one of the plurality of flow courses is an evacuation slot that is positioned across the bit centerline relative to the coring blade; and a plurality of cutting elements disposed on the plurality of blades, wherein one of the plurality of cutting elements is a first cutting element disposed on the coring blade at a first radial position from the bit centerline, wherein the first cutting element is a conical cutting element embedded in the coring blade such that an apex of the conical cutting element is oriented toward the bit centerline, wherein a support surface is disposed between the coring blade and the evacuation slot, and integrally connects the coring blade to the evacuation slot, wherein a conical insert is disposed proximate the bit centerline at the support surface, and wherein the conical insert is embedded in the bit body such that an apex of the conical insert is positioned axially above the first radial position of the first cutting element.

In another aspect, embodiments disclosed herein relate to a method of obtaining core sample fragments from a subterranean formation that includes: securing a drill bit to a lower end of a drill string; rotating the drill string to cause the drill bit to penetrate and cut through the formation, creating a wellbore; using the first cutting element of the drill bit to form a core sample fragment proximate the bit centerline of the drill bit during rotation of the drill string, wherein the core sample fragment has a width based on the first radial position of the first cutting element; using the angled surface of the coring blade to exert a lateral load on a side of the core sample fragment in order to cause the core sample fragment to break away from the formation after the core sample fragment reaches a length; relaying the core sample fragment to the evacuation slot of the drill bit; and transporting the core sample fragment from the evacuation slot to a surface of the formation via an annulus formed between the wellbore and the drill string.

In yet another aspect, embodiments disclosed herein relate to a method of obtaining a core sample fragment from a subterranean formation that includes: securing a drill bit to a lower end of a drill string; rotating the drill string to cause the drill bit to penetrate and cut through the formation, creating a wellbore; using the conical cutting element embedded in the coring blade of the drill bit to score the formation as a core sample fragment is formed proximate the bit centerline of the drill bit during rotation of the drill string, wherein the core sample fragment has a width based on the first radial position of the conical cutting element embedded in the coring blade; using the conical cutting element embedded in the coring blade to weaken the core sample fragment in order to cause the core sample fragment to break away from the formation after the core sample fragment reaches a length; in an event that the conical cutting element embedded in the coring blade fails to break the core sample fragment away from the formation, using a conical insert disposed proximate the bit centerline of the drill bit to exert a central load on an end of the core sample fragment to break the core sample fragment away from the formation after the core sample fragment reaches the length, wherein the conical insert disposed proximate the bit centerline of the drill bit is embedded in the bit body such that an apex of the conical insert is positioned axially above the first radial position of the conical cutting element embedded in the coring blade; relaying the core sample fragment to the evacuation slot of the drill bit; and transporting the core sample fragment from the evacuation slot to a surface of the formation via an annulus formed between the wellbore and the drill string.

Other aspects and advantages of the disclosure will be apparent from the following description and the appended claims.

DETAILED DESCRIPTION

Embodiments of the present disclosure will be described below with reference to the figures. In one aspect, embodiments disclosed herein relate to apparatus and methods for obtaining core sample fragments from a subterranean formation. In particular, embodiments disclosed herein relate to fixed cutter drill bits for obtaining core sample fragments from a subterranean formation.

Figure 1:
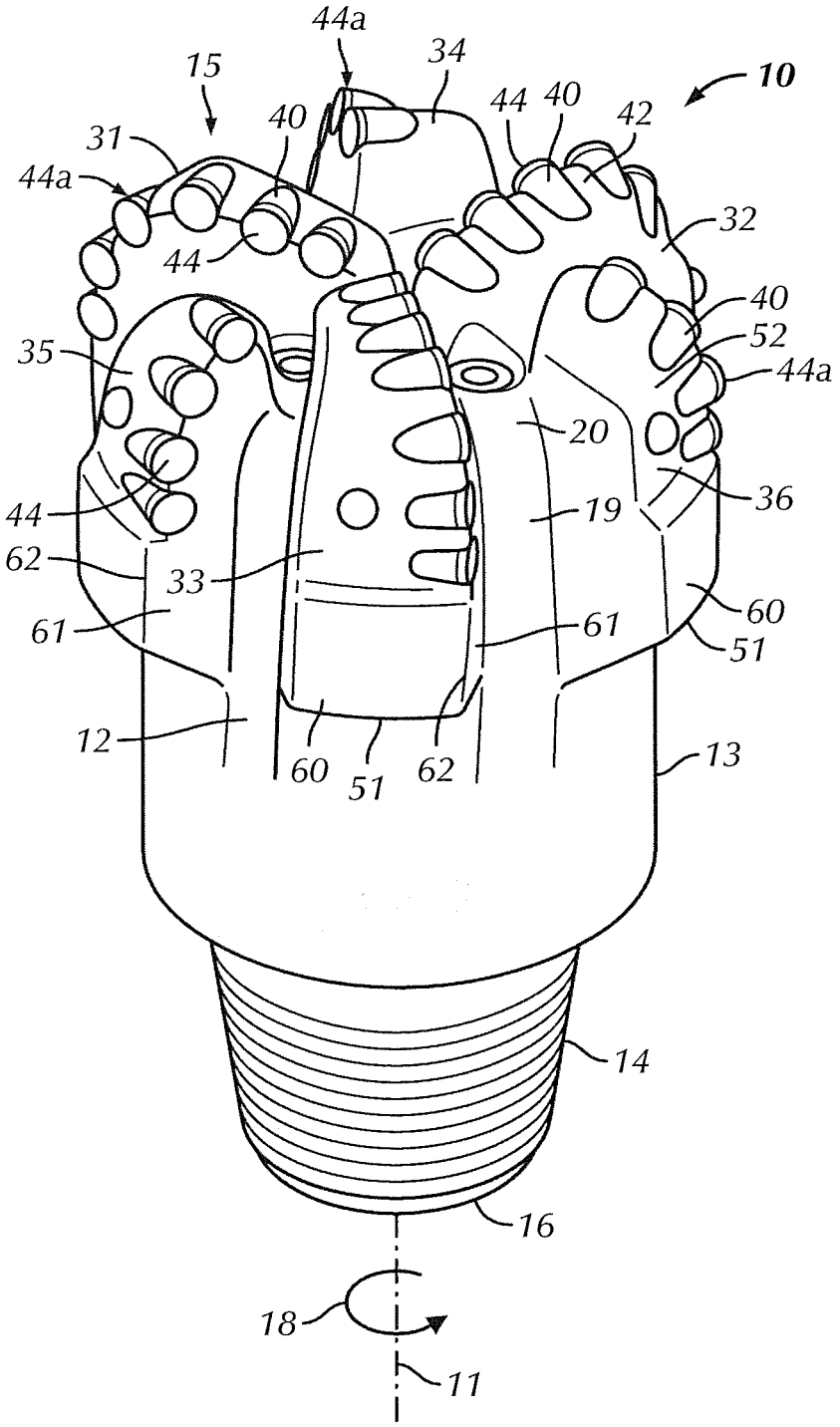
FIG. 1 (Prior Art)
FIG. 1 shows a perspective view of a prior art PDC drill bit.
Figure 2:
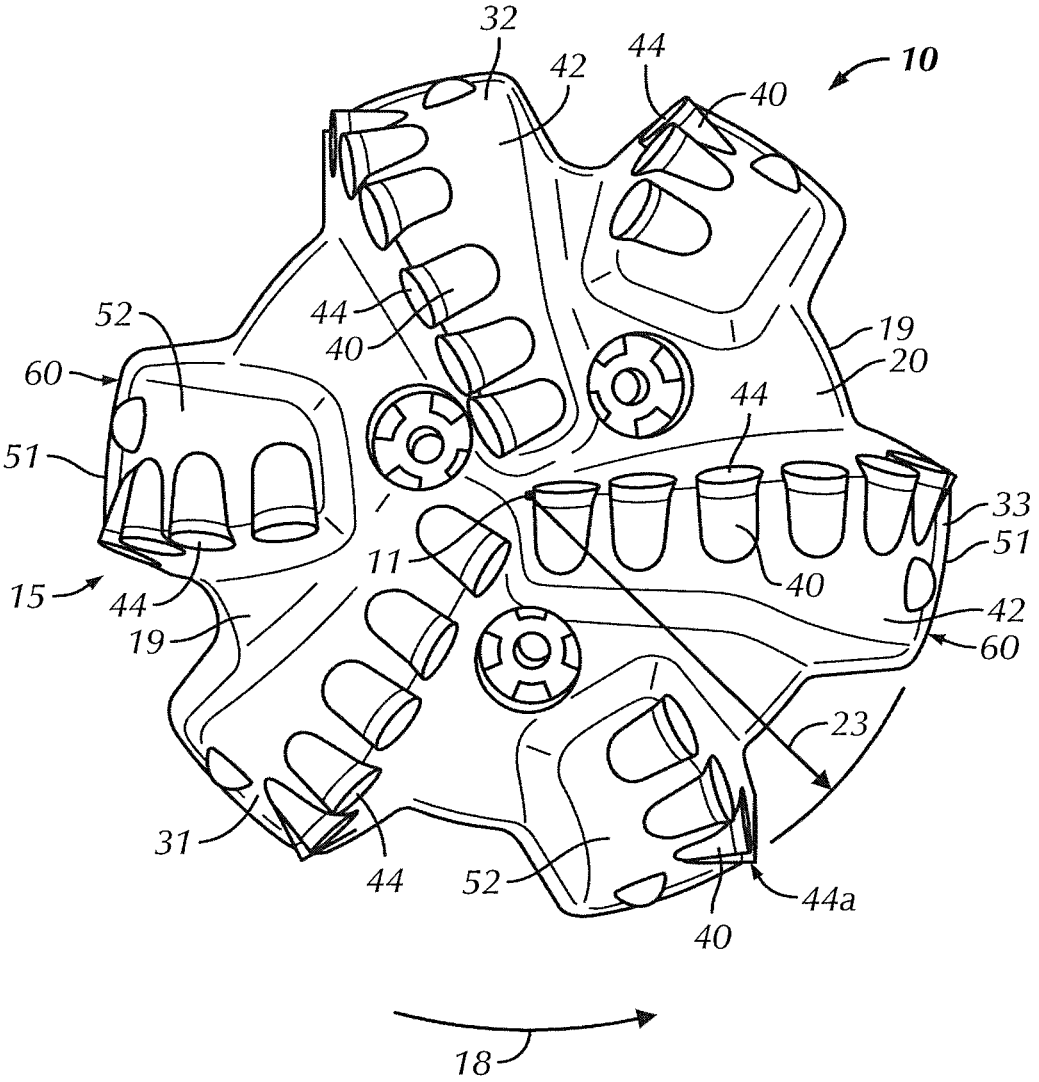
FIG. 2 (Prior Art)
FIG. 2 shows a top view of a prior art PDC drill bit.
Figure 3:
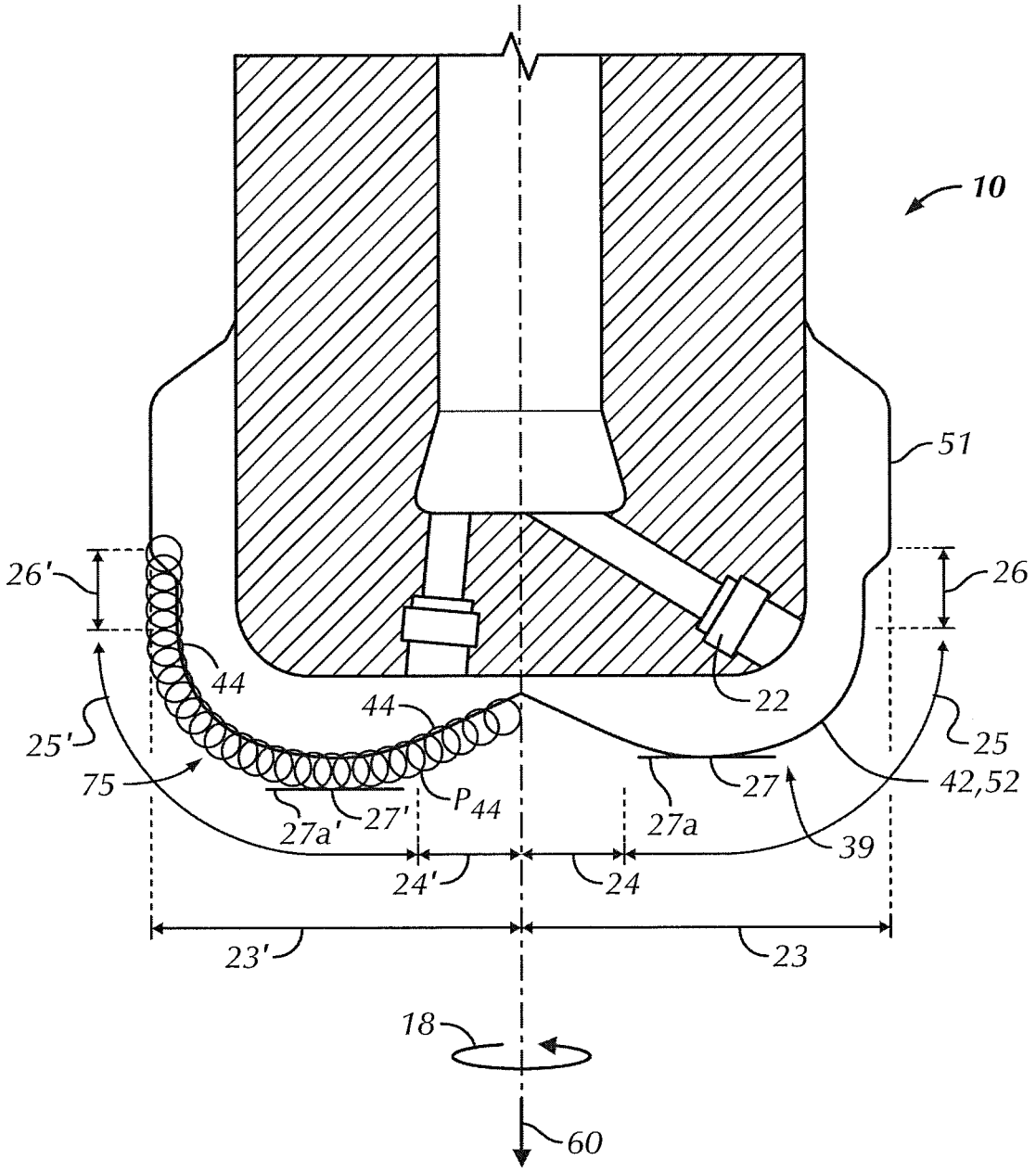
FIG. 3 (Prior Art)
FIG. 3 shows a cross-sectional view of a prior art PDC drill bit.
Figure 5:
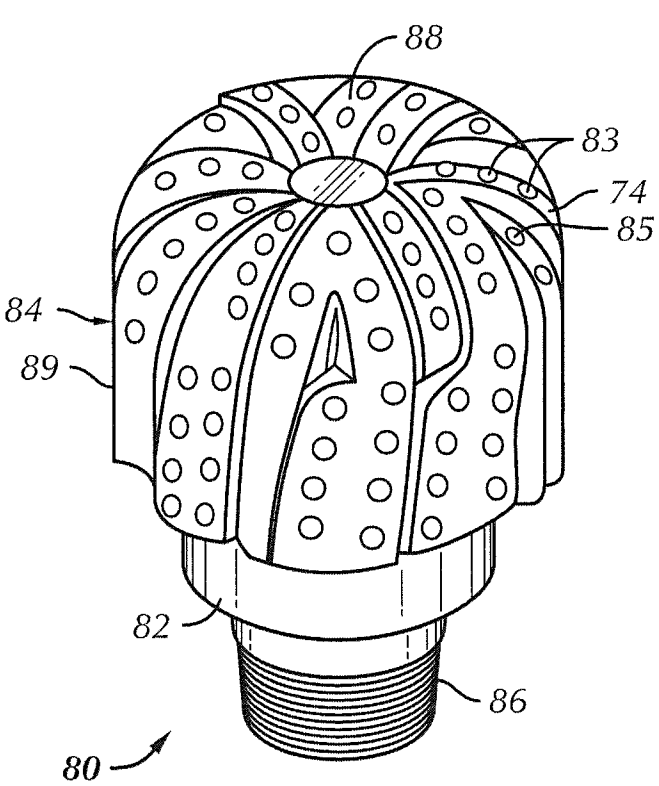
FIG. 5 (Prior Art)
FIG. 5 shows a perspective view of a prior art impregnated drill bit.
Figure 4:
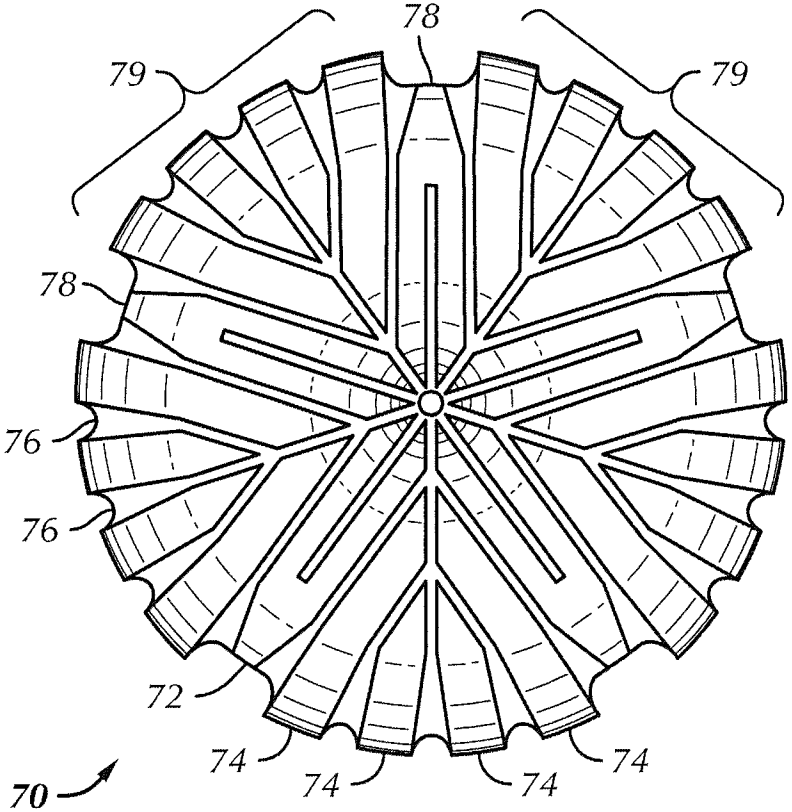
FIG. 4 (Prior Art)
FIG. 4 shows a top view of a prior art impregnated drill bit.
Figure 6:
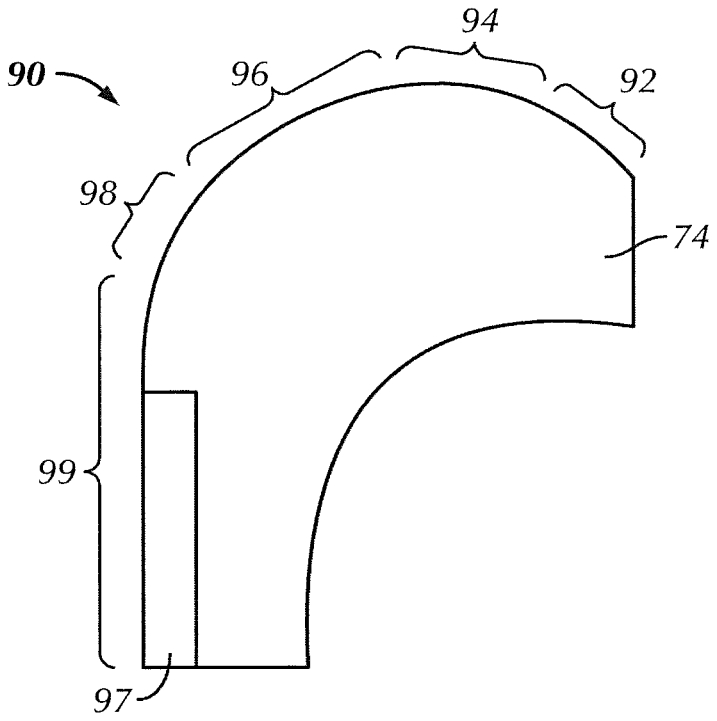
FIG. 6 (Prior Art)
FIG. 6 shows a cross-sectional view of a rib of a prior art impregnated drill bit.
Figure 7:
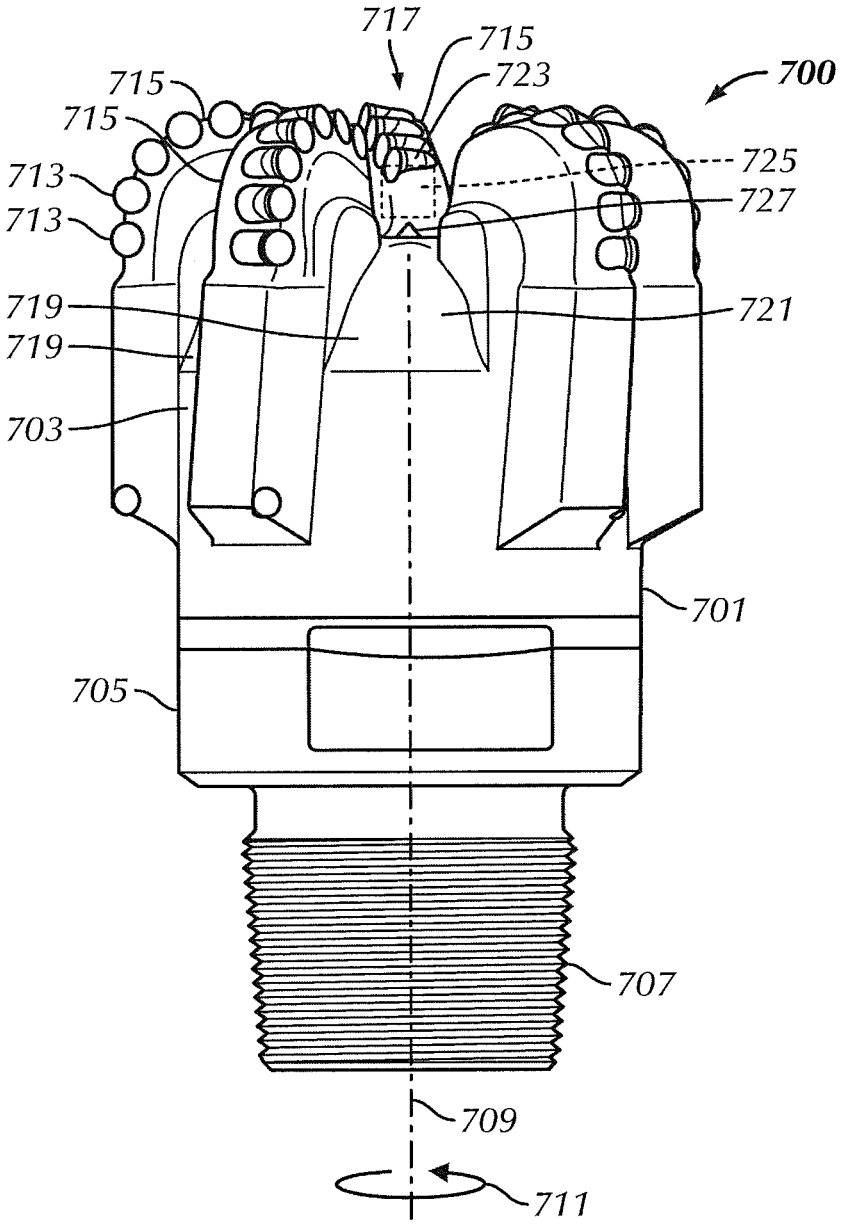
FIG. 7 shows a perspective view of a drill bit with a core sample fragment according to one or more embodiments of the present disclosure.
Figure 8:
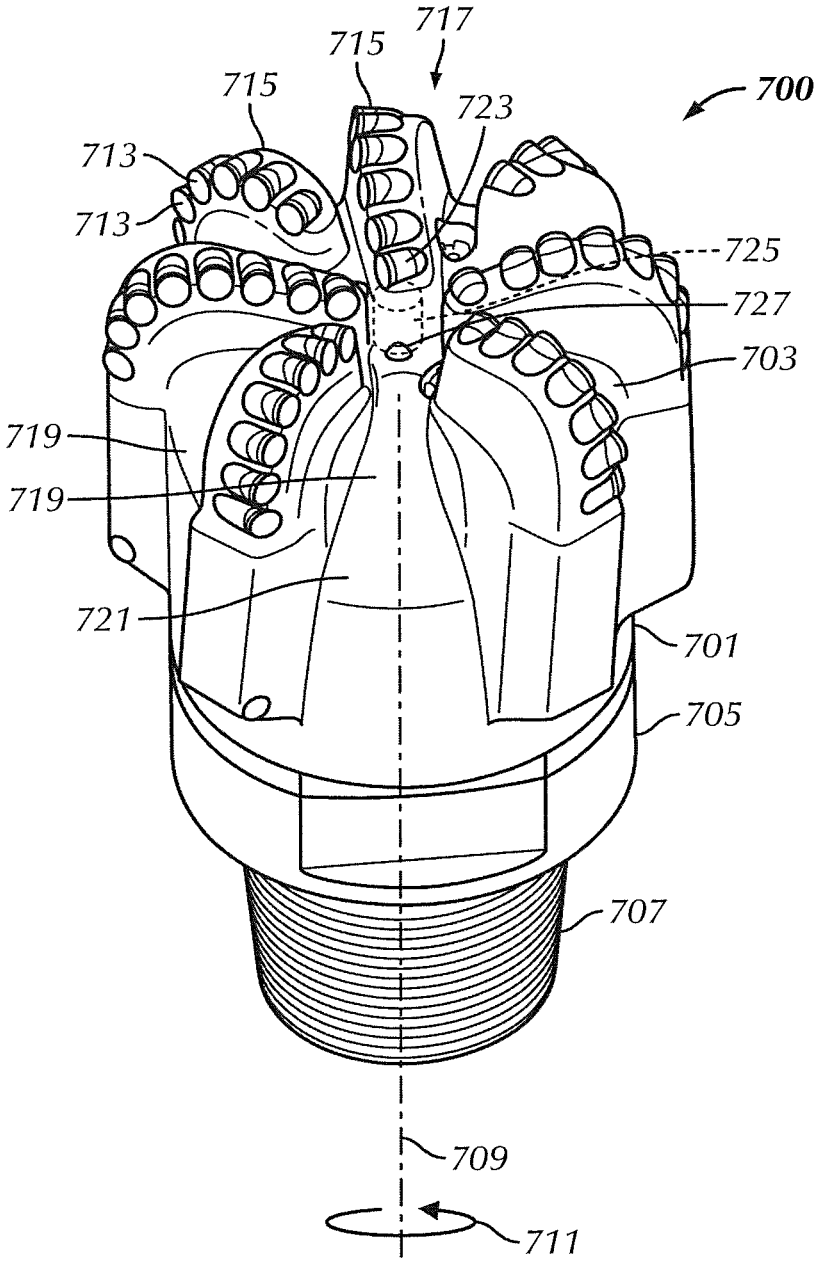
FIG. 8 shows another perspective view of a drill bit with a core sample fragment according to one or more embodiments of the present disclosure.

Referring to FIGS. 7 and 8, perspective views of a drill bit with a core sample fragment according to one or more embodiments of the present disclosure are shown. As shown, the drill bit is a PDC bit 700 that includes a bit body 701, a bit face 703, a shank 705, and a pin 707. Pin 707 is used to secure PDC bit 700 to the lower end of a drill string (not shown). PDC bit 700 further includes a bit centerline 709 about which PDC bit 700 rotates in the cutting direction represented by arrow 711. According to one or more embodiments of the present disclosure, bit face 703 extends through bit centerline 709 and smoothly transitions into and between flow courses 719, which are described in further detail below.

When PDC bit 700 is secured to the drill string, rotating the drill string causes PDC bit 700 to rotate and penetrate and cut through a subterranean formation using a plurality of cutting elements 713, which are described in further detail below. As PDC bit 700 penetrates and cuts through the subterranean formation, a wellbore is formed.

As shown in FIGS. 7 and 8, bit face 703 of PDC bit 700 supports a plurality of blades 715. Plurality of blades 715 are formed on an end of PDC bit 700 that is opposite pin 707. As shown, plurality of blades 715 extend radially along bit face 703 and then axially along a portion of the periphery of PDC bit 700. According to one or more embodiments of the present disclosure, one of the plurality of blades is a coring blade 717, which is described in further detail below. Plurality of blades 715 are separated by a plurality of flow courses 719, which enable drilling fluid to flow between and both clean and cool plurality of blades 715 during drilling. According to one or more embodiments of the present disclosure, one of the plurality of flow courses 719 is an evacuation slot 721, which is described in further detail below.

As further shown in FIGS. 7 and 8, each of the plurality of blades 715 includes plurality of cutting elements 713 disposed thereon. As shown, plurality of cutting elements 713 are arranged adjacent one another in a radially extending row proximal the leading edge of each of the plurality of blades 715. Plurality of cutting elements 713 may have a substantially planar cutting face in order to achieve a shearing cutting action while drilling a formation. In other embodiments, any one of the plurality of cutting elements 713 may be rotatable cutting elements, such as those disclosed in U.S. Pat. No. 7,703,559, U.S. Patent Publication No. 2010/0219001, and U.S. patent application Ser. Nos. 13/152,626, 61/479,151, and 61/479,183, all of which are assigned to the present assignee and herein incorporated by reference in their entirety. In other embodiments, any one of the plurality of cutting elements 713 may be "conical cutting elements," such as those described in U.S. patent application Ser. Nos. 61/441,319, 13/370,734, 61/499,851, 13/370,862, and 61/609,527, all of which are assigned to the present assignee and herein incorporated by reference in their entirety. Conical cutting elements are also described in further detail below.

According to one or more embodiments of the present disclosure, one of the plurality of cutting elements 713 is a first cutter (or first cutting element) 723 disposed on the coring blade 717. As described in further detail below, first cutter 723 and coring blade 717 work to form and break a core sample fragment 725, such as that shown in FIGS. 7 and 8.

As further shown in FIGS. 7 and 8, PDC bit 700 includes a conical insert 727 embedded in the bit body 701 and disposed on or proximate the bit centerline 709. As described in further detail below, conical insert 727 works with coring blade 717 to cause core sample fragment 725 to break away from the formation during drilling.

Figure 9:
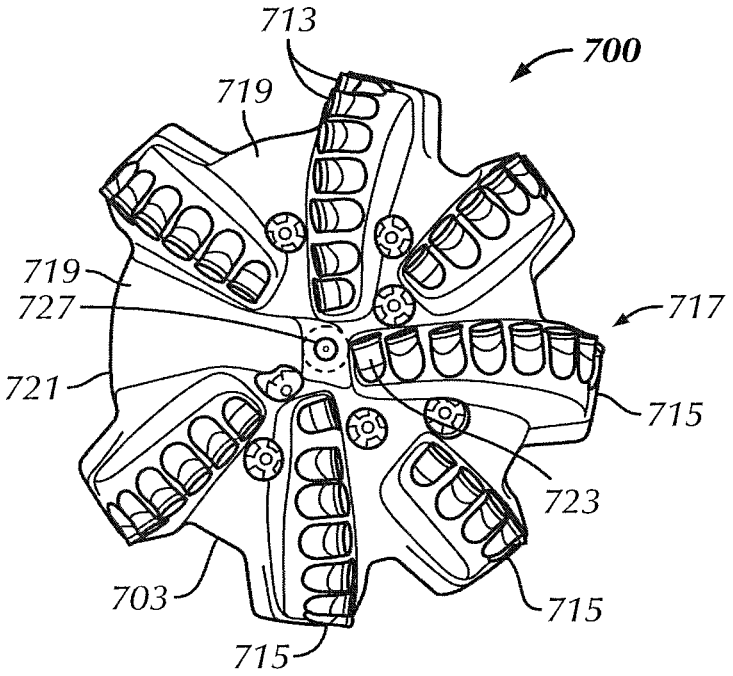
FIG. 9 shows a top view of a drill bit according to one or more embodiments of the present disclosure.

Referring now to FIG. 9, a top view of a drill bit according to one or more embodiments of the present disclosure is shown. Specifically, FIG. 9 shows a top view of PDC bit 700 according to one or more embodiments of the present disclosure. The core sample fragment 725 is not shown in FIG. 9 in order to provide an unobstructed top view of the structure of PDC bit 700. FIG. 9 shows bit face 703, plurality of cutting elements 713, plurality of blades 715, and plurality of flow courses 719, which have each been previously described. FIG. 9 further shows coring blade 717, evacuation slot 721, first cutter 723, and conical insert 727, each of which are described in further detail below.

Figure 10:
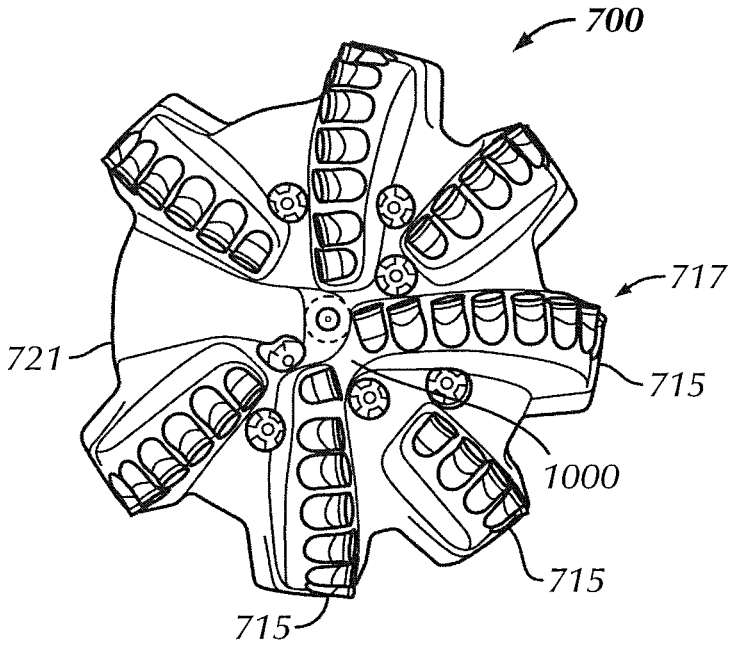
FIG. 10 shows a top view of a drill bit according to one or more embodiments of the present disclosure.

Referring now to FIG. 10, a top view of a drill bit according to one or more embodiments of the present disclosure is shown. Specifically, FIG. 10 shows a top view of PDC bit 700 according to one or more embodiments of the present disclosure. FIG. 10 is similar to FIG. 9 except that bridge portion 1000 is shown, according to one or more embodiments of the present disclosure. For the sake of clarity, some of the elements of FIG. 10 that overlap with those shown in FIG. 9 have been omitted.

As shown in FIG. 10, according to one or more embodiments of the present disclosure, bridge portion 1000 connects together the centrally located adjacent end portions of at least two of the plurality of blades 715. According to one or more embodiments of the present disclosure, bridge portion 1000 connects together the centrally located end portion of the coring blade 717 to an adjacent centrally located end portion of at least one of the plurality of blades 715. The connection provided by bridge portion 1000 may bridge centrally located adjacent end portions of at least two of the plurality of blades 715 into an integral piece. In some embodiments, bridge portion 1000 may bridge coring blade 717 and one of the plurality of blades 715 that is not a coring blade 717, or bridge portion 1000 may bridge at least two of the plurality of blades 715 that are not coring blade 717.

Referring to FIGS. 7 through 10, as PDC bit 700 is rotated within the formation, PDC bit 700 acts to form a wellbore by action of plurality of cutting elements 713, and simultaneously acts to form core sample fragment 725 by action of first cutter 723 of coring blade 717. As core sample fragment 725 forms during drilling, bit hydraulics along bit face 703 and between plurality of flow courses 719 help relay a newly formed core sample fragment 725 toward evacuation slot 721 of PDC bit 700.

Referring now to FIG. 10, when bridge portion 1000 is employed as previously described in accordance with one or more embodiments of the present disclosure, the mechanical structure of bridge portion 1000 creates a boundary, and along with bit hydraulics, helps to direct a newly form core sample fragment 725 toward evacuation slot 721 of PDC bit 700.

Figure 11:
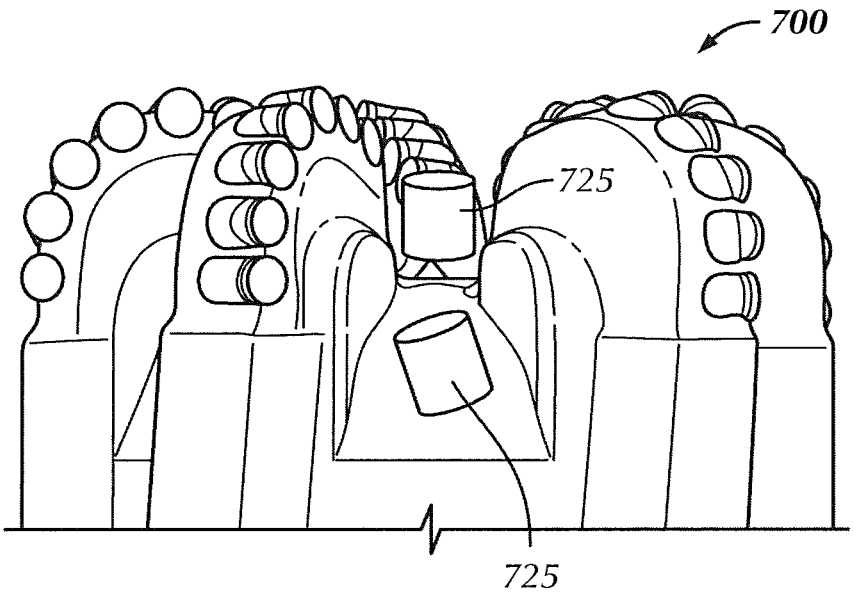
FIG. 11 shows a partial perspective view of a drill bit with core sample fragments according to one or more embodiments of the present disclosure.
Figure 12:
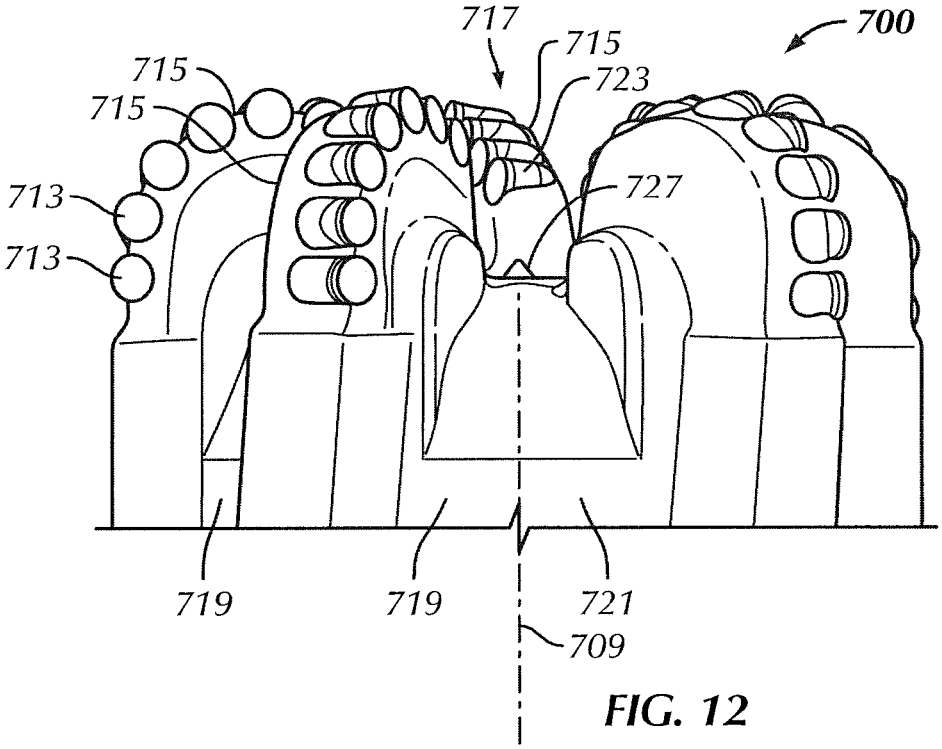
FIG. 12 shows a partial perspective view of a drill bit without core sample fragments according to one or more embodiments of the present disclosure.

Referring now to FIG. 11, a partial perspective view of a drill bit with core sample fragments 725 according to one or more embodiments of the present disclosure is shown. Specifically, FIG. 11 shows a partial perspective view of PDC bit 700 according to one or more embodiments of the present disclosure. Referring now to FIG. 12, the partial perspective view of PDC bit 700 according to one or more embodiments of the present disclosure as shown in FIG. 11 is shown without core sample fragments 725 in order to provide an unobstructed partial perspective view of the structure of PDC bit 700.

FIG. 12 shows plurality of cutting elements 713, plurality of blades 715, and plurality of flow courses 719, which have each been previously described. FIG. 12 further shows coring blade 717, evacuation slot 721, first cutter 723, and conical insert 727, each of which are described in further detail below.

Figure 13:
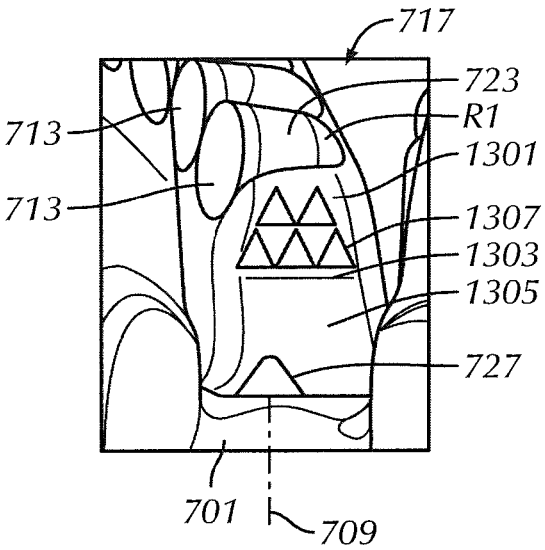
FIG. 13 shows a partial blown-up view of the drill bit shown in FIG. 12 according to one or more embodiments of the present disclosure.
Figure 14:
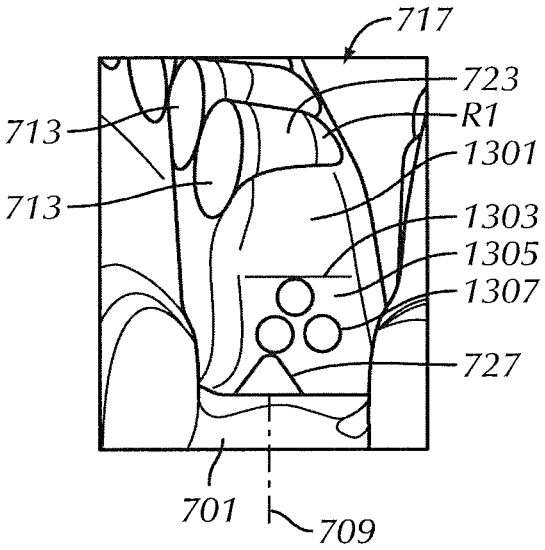
FIG. 14 shows another partial blown-up view of the drill bit shown in FIG. 12 according to one or more embodiments of the present disclosure.

As shown in FIG. 12, coring blade 717 is one of plurality of blades 715 of PDC bit 700. Referring now to FIGS. 13-14, partial blown-up views of the PDC bit 700 shown in FIG. 12 according to one or more embodiments of the present disclosure are shown. Specifically, FIGS. 13-14 focus on coring blade 717. As shown, according to one or more embodiments of the present disclosure, coring blade 717 has plurality of cutting elements 713 disposed thereon. One of plurality of cutting elements 713 is first cutter 723. According to one or more embodiments of the present disclosure, first cutter 723 is disposed on coring blade 717 at a first radial position R1 from bit centerline 709. First radial position R1 is determined by rotating all of the cutting elements 713 into a single rotated view to produce a cutting profile. The cutting element 713 located closest to bit centerline 709, i.e., at the first radial position R1, is the first cutter 723.

In accordance with one or more embodiments of the present disclosure, first radial position R1 is located at some distance away from bit centerline 709 to allow for the formation of core sample fragment 725. As a non-limiting example, according to one or more embodiments of the present disclosure, first radial position R1 is distanced from bit centerline 709 at a distance that measures 0.25 times the diameter of PDC bit 700. According to one or more embodiments of the present disclosure, first radial position R1 may be distanced from bit centerline 709 at a distance measuring in a range of 0.05 times the diameter of PDC bit 700 to 0.25 times the diameter of PDC bit 700. According to other embodiments of the present disclosure, first radial position R1 may be distanced from bit centerline 709 at a distance measuring in a range having a lower limit of any of 0.05, 0.075, 0.1, 0.125, or 0.15 times the diameter of PDC bit 700 to an upper limit of any of 0.075, 0.1, 0.125, 0.15, 0.175, 0.2, 0.225, or 0.25 times the diameter of PDC bit 700, where any lower limit may be used in combination with any upper limit. As understood by one of ordinary skill in the art, first radial position R1 may be located at other distances away from bit centerline 709, depending on the desired size of the core sample fragment 725, without departing from the scope of the present disclosure.

According to one or more embodiments of the present disclosure, first cutter 723 of coring blade 717 is used to form core sample fragment 725 at or near bit centerline 709 during drilling of wellbore. Specifically, first cutter 723 cuts core sample fragment 725 out of formation as PDC bit 700 rotates about bit centerline 709 during drilling of wellbore. According to one or more embodiments of the present disclosure, first cutter 723 may have a substantially planar cutting face. In other embodiments, first cutter 723 may be a conical cutting element, which is described in further detail below. The location of first radial position R1, at which first cutter 723 is disposed, determines the resulting width or diameter of the core sample fragment 725. For example, if first radial position R1 is located at a distance away from bit centerline 709 that measures 0.25 times the diameter of PDC bit 700 in accordance with one or more embodiments of the present disclosure, first cutter 723 disposed at first radial position R1 will form a core sample fragment 725 having a radius that measures 0.25 times the diameter of PDC bit 700, and a width or diameter that measures 0.5 times the diameter of PDC bit 700. The further away first radial position R1 is from bit centerline 709, the larger the width of the resulting core sample fragment 725. Likewise, the closer first radial position R1 is to bit centerline 709, the smaller the width of the resulting core sample fragment 725. Accordingly, as understood by one of ordinary skill in the art, first radial position R1 may be located at various distances away from bit centerline 709 in order to create core sample fragments 725 having various widths without departing from the scope of the present disclosure.

As further shown in FIGS. 13-14, according to one or more embodiments of the present disclosure, coring blade 717 may include substantially vertical surface 1301, relief 1303, and angled surface 1305. Angled surface 1305 is disposed axially above the blade top and axially below bit face 703, which extends through bit centerline 709. In some embodiments, bit face 703 may have an insert inserted into a hole therein, which may be on or proximate bit centerline 709. As shown, relief 1303 may be disposed between substantially vertical surface 1301 and angled surface 1305. Relief 1303 functions to relieve and protect substantially vertical surface 1301 from premature wear. According to one or more embodiments of the present disclosure, substantially vertical surface 1301, relief 1303, and angled surface 1305 are integrally connected to form a continuous piece, and are oriented to face bit centerline 709 of PDC bit 700.

According to other embodiments of the present disclosure, coring blade 717 may be configured without relief 1303. According to these other embodiments, substantially vertical surface 1301 and angled surface 1305 are integrally connected to form a continuous piece, and are oriented to face bit centerline 709 of PDC bit 700. Further, according to these other embodiments, substantially vertical surface 1301 and angled surface 1305 intersect at a point that is axially above first cutter 723 of coring blade 717.

According to one or more embodiments of the present disclosure, substantially vertical surface 1301 may be substantially parallel to bit centerline 709 of PDC bit 700. That is, according to one or more embodiments of the present disclosure, substantially vertical surface 1301 may be oriented such that substantially vertical surface 1301 is at an angle ranging from 0 to 5 degrees, in either direction, with respect to a line parallel to bit centerline 709 of PDC bit 700. As better shown in FIG. 16, to be further described below, the slope of angled surface 1305 helps determine the length of resulting core sample fragment 725. For example, the shallower the slope (i.e., the larger the degree of angle from bit centerline 709) of angled surface 1305, the longer the length of resulting core sample fragment 725. Likewise, the steeper the slope (i.e., the smaller the degree of angle from bit centerline 709) of angled surface 1305, the shorter the length of resulting core sample fragment 725. As understood by one of ordinary skill in the art, in addition to the slope of angled surface 1305, the height of coring blade 717 also helps determine the length of the resulting core sample fragment 725. For example, the taller the coring blade 717, the longer the length of resulting core sample fragment 725. Likewise, the shorter the coring blade 717, the shorter the length of resulting core sample fragment 725. Accordingly, as understood by one of ordinary skill in the art, angled surface 1305 may have an angle of various degrees from bit centerline 709, and coring blade 717 may have various heights in order to create core sample fragments 725 having various lengths without departing from the scope of the present disclosure. In a particular embodiment, angled surface 1305 may by disposed such that the axial point at which angled surface 1305 has a radial value equal to the radial position of the first cutter 723 may have a lower limit of any of at least 0.1, 0.2, 0.3, 0.4, or 0.5 times the diameter of the bit, and an upper limit of any of 0.2, 0.3, 0.4, 0.5, 0.6, or 0.75 times the diameter of the bit, where any lower limit can be used in combination with any upper limit.

According to one or more embodiments of the present disclosure, angled surface 1305 has an angle in a range of 15 degrees to 20 degrees from bit centerline 709. However, in view of the above, this angle range is not intended to be limiting, and angled surface 1305 may have an angle of various degrees from bit centerline 709. For example, in one or more embodiments, angled surface 1305 may have a lower limit of any of about 5, 10, 15, 20, or 25 degrees, and an upper limit of any of 15, 20, 25, 30, 35, or 45 degrees. According to one or more embodiments of the present disclosure, angled surface 1305 may have any angle from bit centerline 709 that allows angled surface 1305 to exert a lateral load on a side of core sample fragment 725 that is sufficient to cause core sample fragment 725 to break away from formation after core sample fragment 725 reaches a desired length. The function of angled surface 1305 in this regard is described further below with respect to FIG. 16.

Referring back to FIGS. 13-14, according to one or more embodiments of the present disclosure, relief 1303 may be disposed between substantially vertical surface 1301 and angled surface 1305. Relief 1303 functions to relieve and protect substantially vertical surface 1301 from premature wear. According to one or more embodiments of the present disclosure, the location of relief 1303 between substantially vertical surface 1301 and angled surface 1305 is based upon the desired length to width ratio of the resulting core sample fragment 725. According to one or more embodiments of the present disclosure, the ratio of the length of core sample fragment 725 to the width of core sample fragment 725 may be greater than or equal to one. As such, the location of relief 1303 is determined based on the height of the coring blade 717, the slope of angled surface 1305, and the location of first radial position R1 with respect to bit centerline 709, as previously described above.

Referring to FIG. 13, according to one or more embodiments of the present disclosure, substantially vertical surface 1301 may have a low friction abrasion resistant surface 1307 because of the load or loads that are exerted by and imposed upon substantially vertical surface 1301 during drilling. Use of low friction abrasion resistant surface 1307 may provide abrasion protection for substantially vertical surface 1301, which enhances the service life of PDC bit 700. According to one or more embodiments of the present disclosure, use of low friction abrasion resistant surface 1307 on substantially vertical surface 1301 may also provide additional cutting action during formation of core sample fragment 725. According to one or more embodiments of the present disclosure, low friction abrasion resistant surface 1307 may either be integral with substantially vertical surface 1301, or may be formed from one or more non-integral pieces, such as the triangles shown in FIG. 13, for example. Although triangle-shaped non-integral pieces are shown in FIG. 13, one of ordinary skill in the art would understand that one or more embodiments of the present disclosure are not limited to pieces of a particular shape. Indeed, squares, circles, ovals, diamonds, discs, wedges, or any other shape that is capable of providing abrasion protection to substantially vertical surface 1301 may be used.

According to one or more embodiments of the present disclosure, low friction abrasion resistant surface 1307 is integral with substantially vertical surface 1301 and is formed during formation of coring blade 717 of PDC bit 700. According to one or more embodiments of the present disclosure, the material used for low friction abrasion resistant surface 1307 may be either thermally stable polycrystalline diamond (TSP), natural diamond, or any other type of thermally stable abrasion resistant material. According to one or more embodiments of the present disclosure, the material used for low friction abrasion resistant surface 1307 is TSP.

Referring to FIG. 14, according to one or more embodiments of the present disclosure, angled surface 1305 may have a low friction abrasion resistant surface 1307 because of the load or loads that are exerted by and imposed upon angled surface 1305 during drilling. Use of low friction abrasion resistant surface 1307 provides abrasion protection for angled surface 1305, which ensures durability from wear, thereby enhancing the service life of PDC bit 700. According to one or more embodiments of the present disclosure, low friction abrasion resistant surface 1307 may either be integral with angled surface 1305, or may be formed from one or more non-integral pieces, such as the discs shown in FIG. 14, for example. Although disc-shaped non-integral pieces are shown in FIG. 14, one of ordinary skill in the art would understand that one or more embodiments of the present disclosure are not limited to pieces of a particular shape. Indeed, triangles, squares, circles, ovals, diamonds, wedges, or any other shape that is capable of providing abrasion protection to angled surface 1305 may be used.

According to one or more embodiments of the present disclosure, low friction abrasion resistant surface 1307 is integral with angled surface 1305 and is formed during formation of coring blade 717 of PDC bit 700. According to one or more embodiments of the present disclosure, the material used for low friction abrasion resistant surface 1307 may be either TSP, natural diamond, or any other type of thermally stable abrasion resistant material. According to one or more embodiments of the present disclosure, the material used for low friction abrasion resistant surface 1307 is TSP.

FIGS. 13-14 also show conical insert 727 disposed on or proximate bit centerline 709. As used herein, "proximate" with respect to bit centerline 709 means either on bit centerline 709 or between bit centerline 709 and first radial position R1. According to one or more embodiments of the present disclosure, conical insert 727 is embedded in bit body 701 such that an apex of conical insert 727 is positioned axially above relief 1303 of coring blade 717. Conical insert 727 is described in further detail below with respect to FIG. 15.

Figure 15:
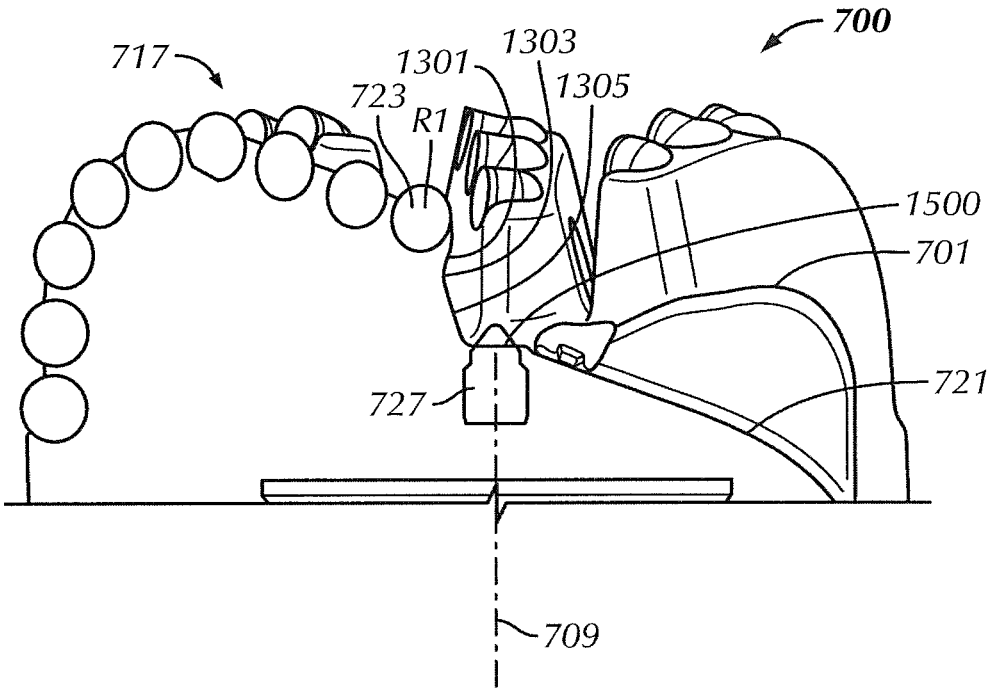
FIG. 15 shows a cross-sectional view of a drill bit according to one or more embodiments of the present disclosure.

Referring now to FIG. 15, a cross-sectional view of a drill bit according to one or more embodiments of the present disclosure is shown. Specifically, FIG. 15 shows a cross-sectional view of PDC bit 700 according to one or more embodiments of the present disclosure. As shown, conical insert 727 is disposed on or proximate bit centerline 709 at a support surface 1500 of bit body 701. According to one or more embodiments of the present disclosure, support surface 1500 is disposed between coring blade 717 and evacuation slot 721 of PDC bit 700. According to one or more embodiments of the present disclosure, support surface 1500 integrally connects coring blade 717 to evacuation slot 721 in a continuous piece. Further, according to one or more embodiments of the present disclosure, support surface 1500 has a slope of less than 5 degrees, less than 3 or 2 degrees in other embodiments, or may even have a slope of zero with respect to bit centerline 709.

Still referring to FIG. 15, according to one or more embodiments of the present disclosure, conical insert 727 is embedded in bit body 701 such that the apex of conical insert 727 is positioned axially above relief 1303 of coring blade 717. As used herein, "conical insert" refers to a cutting element having a generally conical cutting end (including either a right cone or oblique cone) that terminates in a rounded apex. According to one or more embodiments of the present disclosure, the apex of the conical insert 727 may have curvature between side surfaces of the conical insert 727 and the apex. The structure of conical insert 727 may allow cutting of a resulting fragment 725 by compressive fracture or gouging.

As shown, according to one or more embodiments of the present disclosure, conical insert 727 may be a rigid cutting element configured in the general shape of a cone. However, the shape of conical insert 727 is not intended to be limiting, and conical insert 727 may be configured in a different shape than a cone. As understood by one of ordinary skill in the art, according to one or more embodiments of the present disclosure, conical insert 727 may have any shape that acts to break up core sample fragment 725 that comes in contact therewith.

According to one or more embodiments of the present disclosure, conical insert 727 may be formed as an integral element of bit body 701, or as a non-integral insert made of a polycrystalline superabrasive material. According to one or more embodiments of the present disclosure, conical insert 727 is a non-integral insert that includes a substrate (such as a cemented tungsten carbide substrate) that interfaces with a diamond layer made of a polycrystalline superabrasive material, which may include, for example, polycrystalline diamond, polycrystalline cubic boron nitride, or TSP. According to one or more embodiments of the present disclosure, diamond layer forms a conical diamond working surface of conical insert 727, and substrate forms a base of conical insert 727. Without departing from the scope of the present disclosure, additional shapes, structures, compositions, and dimensions of conical insert 727 may be employed, such as those described with reference to "conical cutting elements" in U.S. Provisional Application No. 61/609,527, which is herein incorporated by reference in its entirety.

Still referring to FIG. 15, evacuation slot 721 is shown positioned directly across bit centerline 709 relative to coring blade 717. According to one or more embodiments of the present disclosure, a profile of evacuation slot 721 is recessed below bit body 701 of PDC bit 700. As understood by one of ordinary skill in the art, the amount that evacuation slot 721 is recessed below bit body 701 may vary without departing from the scope of the present disclosure. For example, as appreciated by one of ordinary skill in the art, evacuation slot 721 may be recessed below bit body 701 by an amount that is sufficient to ensure a smooth exit of core sample fragment 725 from evacuation slot 721 in order to avoid bit plugging. Further, as appreciated by one of ordinary skill in the art, evacuation slot 721 may be recessed below bit body 701 by an amount that does not compromise the blank strength of PDC bit 700. Therefore, according to one or more embodiments of the present disclosure, evacuation slot 721 is recessed below bit body 701 of PDC bit 700 by an amount that allows smooth exit of core sample fragment 725 without bit plugging, and by an amount that does not adversely affect the service life of PDC bit 700. According to one or more embodiments of the present disclosure, evacuation slot 721 has a generally downward slope with respect to support surface 1500 and bit body 701.

Further, in one or more embodiments, the fluid course 719 in which evacuation slot 721 is located comprises a greater circumferential extent of PDC bit 700 than other fluid courses 719. For example, in one or more embodiments, the fluid course 719 in which evacuation slot 721 is located comprises at least a greater than 50% surface area than the other fluid courses 719. In other embodiments, the fluid course 719 in which evacuation slot 721 is located comprises at least a greater than 75%, greater than 100%, or even greater than 150% surface area than the other fluid courses 719. Further, depending on the profile of the bit body 701, it may not be necessary to provide an evacuation slot 721 recessed into the bit body 701, but the slope of the fluid course 719 combined with the surface area of the fluid course 719 opposite the coring blade 717 may be sufficient to result in evacuation of the core sample fragment 725 from the bit body 701 into the annulus to be circulated to the surface.

Figure 16:
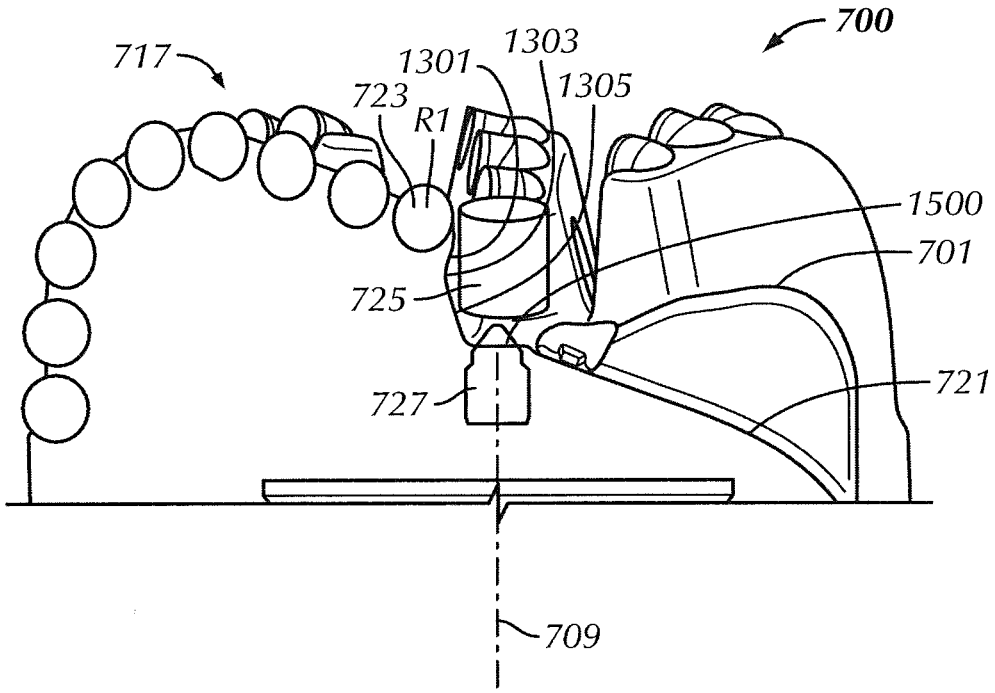
FIG. 16 shows the cross-sectional view of the drill bit shown in FIG. 15 with a core sample fragment according to one or more embodiments of the present disclosure.

Referring now to FIG. 16, the cross-sectional view of the PDC bit 700 shown in FIG. 15 with a core sample fragment 725 according to one or more embodiments of the present disclosure is shown. As previously described, according to one or more embodiments of the present disclosure, first cutter 723 of coring blade 717 is used to form core sample fragment 725 during drilling of wellbore. Specifically, first cutter 723 cuts core sample fragment 725 out of formation as PDC bit 700 rotates about bit centerline 709 during drilling of wellbore. Accordingly, core sample fragment 725 is formed at bit centerline 709 by cutting action of first cutter 723.

Once core sample fragment 725 reaches a particular length, which is determined by height of coring blade 717 and the angle of angled surface 1305 with respect to bit centerline 709 as previously described above, angled surface 1305 of coring blade 717 facilitates the break of core sample fragment 725 from the formation by exerting a lateral load on one side of the newly formed core sample fragment 725. According to one or more embodiments of the present disclosure, this side-loading causes core sample fragment 725 to break away from formation at an end of core sample fragment 725 that is adjacent to formation. The end of core sample fragment 725 that is adjacent formation is the weakest area of core sample fragment 725 due to stresses imparted thereon during formation of core sample fragment 725 by first cutter 723. Accordingly, side-loading by angled surface 1305 causes core sample fragment 725 to break away from formation at the end of core sample fragment 725 that is adjacent formation, in accordance with one or more embodiments of the present disclosure.

According to one or more embodiments of the present disclosure, the resulting core sample fragment 725 has a width in a range of 0.75 inches to 1.25 inches, and a length in a range of 0.75 inches to 1.25 inches. According to other embodiments of the present disclosure, the resulting core sample fragment 725 has a width in a range of 1.9 inches to 2.1 inches, and length in a range of 1.9 inches to 2.1 inches. As understood by one of ordinary skill in the art, resulting core sample fragment 725 may have various lengths and widths without departing from the scope of the present disclosure.

As further shown in FIG. 16, according to one or more embodiments of the present disclosure, the point at which newly formed core sample fragment 725 contacts angled surface 1305 of coring blade 717 is axially below the apex of conical insert 727. Stated another way, according to one or more embodiments of the present disclosure, newly formed core sample fragment 725 hits angled surface 1305 at a point that is at the same radial position as first radial position R1 of first cutter 723. This point is axially below the apex of conical insert 727 according to one or more embodiments of the present disclosure.

According to other embodiments of the present disclosure, first cutter 723 may be a conical insert 727 as previously described above. In these other embodiments, conical insert 727 may be embedded in coring blade 717 at first radial position R1 such that an apex of conical insert 727 is oriented toward bit centerline 709. Further, in these other embodiments, once core sample fragment 725 reaches a particular length, which is determined by the height of coring blade 717 as previously described above, conical insert 727 creates a score in newly formed core sample fragment 725 during drilling. According to one or more embodiments of the present disclosure, this scoring causes core sample fragment 725 to weaken and break away from the formation at an end of core sample fragment 725 that is adjacent to formation. The end of core sample fragment 725 that is adjacent formation is the weakest area of core sample fragment 725 due to stresses imparted thereon during formation of core sample fragment 725 by cutting action of conical insert 727 acting as first cutter 723. Accordingly, scoring by conical insert 727 causes core sample fragment 725 to break away from formation at the end of core sample fragment 725 that is adjacent formation, in accordance with one or more embodiments of the present disclosure.

Figure 30:
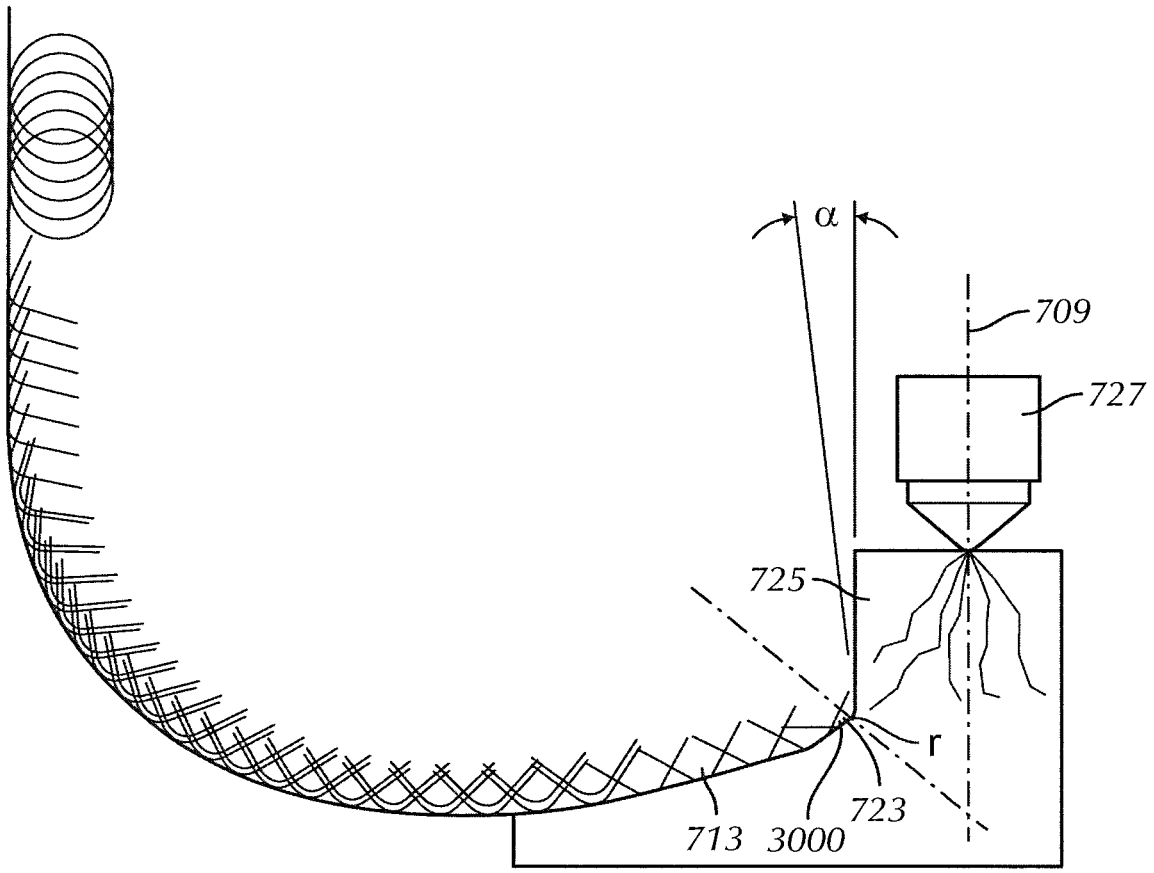
FIG. 30 shows a cutting profile according to one embodiment of the present disclosure.

Referring now to FIG. 30, another embodiment using a conical insert is shown. In the embodiment illustrated, at or adjacent the bit centerline 709, a conical insert 727 is included as a center coring element in conjunction with a plurality of cutting elements 713 disposed on blades (not shown). As shown in FIG. 30, plurality of cutting elements 713 may be conical cutting elements according to one or more embodiments of the present disclosure. In a particular embodiment, the first radial cutting element 723 is a conical cutting element 3000. As further shown, conical insert 727 is attached directly to the bit body (not shown) in a cavity formed between the blades of PDC bit 700 instead of to a blade. Further, while the cutting profile illustrated in this embodiment is shown as only containing a plurality of conical cutting elements 713, it is specifically within the scope of the present disclosure that a cutting profile may include a plurality of cutters (not shown) and/or a plurality of conical cutting elements in any of the configurations described in U.S. patent application Ser. Nos. 13/370,734 and 13/370,862, both of which are incorporated by reference in their entirety, or any other configuration.

Embodiments having a conical cutting element 3000 as the first radial cutting element 723 may use conical cutting elements 3000 having a radius ranging from 0.010 to 0.125 inches in particular embodiments. In some embodiments, the radius r of the conical cutting element 3000 at the first radial position R1 may range from a lower limit of any of 0.01, 0.02, 0.04, 0.05, 0.06, or 0.075 inches, and an upper limit of any of 0.05, 0.06, 0.075, 0.085, 0.10, or 0.0125 inches, where any lower limit may be used in combination with any upper limit. Additionally, particular embodiments may use an asymmetrical or oblique cutting element where a cutting conical cutting end portion of the conical cutting element 3000 has an axis that is not coaxial with the axis of the substrate. Further, it may also be desirable to place the conical cutting element 3000 at a particular rake orientation (i.e., vertical or lateral orientation) on the coring blade 717 (for the given degree of asymmetry as well as cone angle for the particular conical cutting element 713) such that there is an angle $\alpha$ formed between the most radially interior portion of the conical cutting element 3000 and a line parallel to the bit centerline 709. In various embodiments, a may range from 0 to 45 degrees. In other embodiments, an angle $\alpha$ may be greater than 0 degrees. In some embodiments, the angle $\alpha$ may range from a lower limit of any of greater than 0, 2, 5, 10, 15, 20, or 30 degrees to an upper limit of any of 15, 20, 25, 30, 35, 40, or 45 degrees, where any lower limit may be used in combination with any upper limit. Advantageously, placement of a conical cutting element 3000 at the first radial position R1 of the coring blade 717 may allow for weakening on the core strength of the core sample fragment 725 formed in the center region of PDC bit 700 by allowing for the conical cutting element 3000 to create a score therein. Further, according to one or more embodiments of the present disclosure, coring blade 717 having conical cutting element 3000 at first radial position R1 may be configured with or without angled surface 1305 as previously described above.

In the event that the lateral load exerted by angled surface (or, according to other embodiments, the scoring by conical cutting element 3000 as the first radial cutting element 723 embedded in coring blade 717 as previously described above) is insufficient to break core sample fragment 725 away from formation, conical insert 727 embedded proximate bit centerline 709 may function to cause core sample fragment 725 to break away from formation as a back-up. Specifically, according to one or more embodiments of the present disclosure, conical insert 727 embedded proximate bit centerline 709 exerts a central load on the end of core sample fragment 725 that is closest to the apex of conical insert 727. The central load exerted by conical insert 727 causes core sample fragment 725 to fracture or crack. As a result of this central load and because conical insert 727 is disposed on or proximate bit centerline 709, core sample fragment 725 breaks into two halves. According to one or more embodiments of the present disclosure, these two halves are substantially equal in length and width.

After core sample fragment 725 is broken away from formation in accordance with one or more embodiments of the present disclosure, bit hydraulics and/or bridge portion 1000 (as previously described above) help newly extracted core sample fragment 725 to be relayed and/or directed toward evacuation slot 721 for exit of PDC bit 700. As previously described, the general downward slope of evacuation slot 721 in accordance with one or more embodiments of the present disclosure enables core sample fragment 725 to exit PDC bit 700 without bit plugging. According to one or more embodiments of the present disclosure, from evacuation slot 721, core sample fragment 725 is transported to the surface of the formation via an annulus (not shown) that is formed between the wellbore and the drill string.

Figure 17:
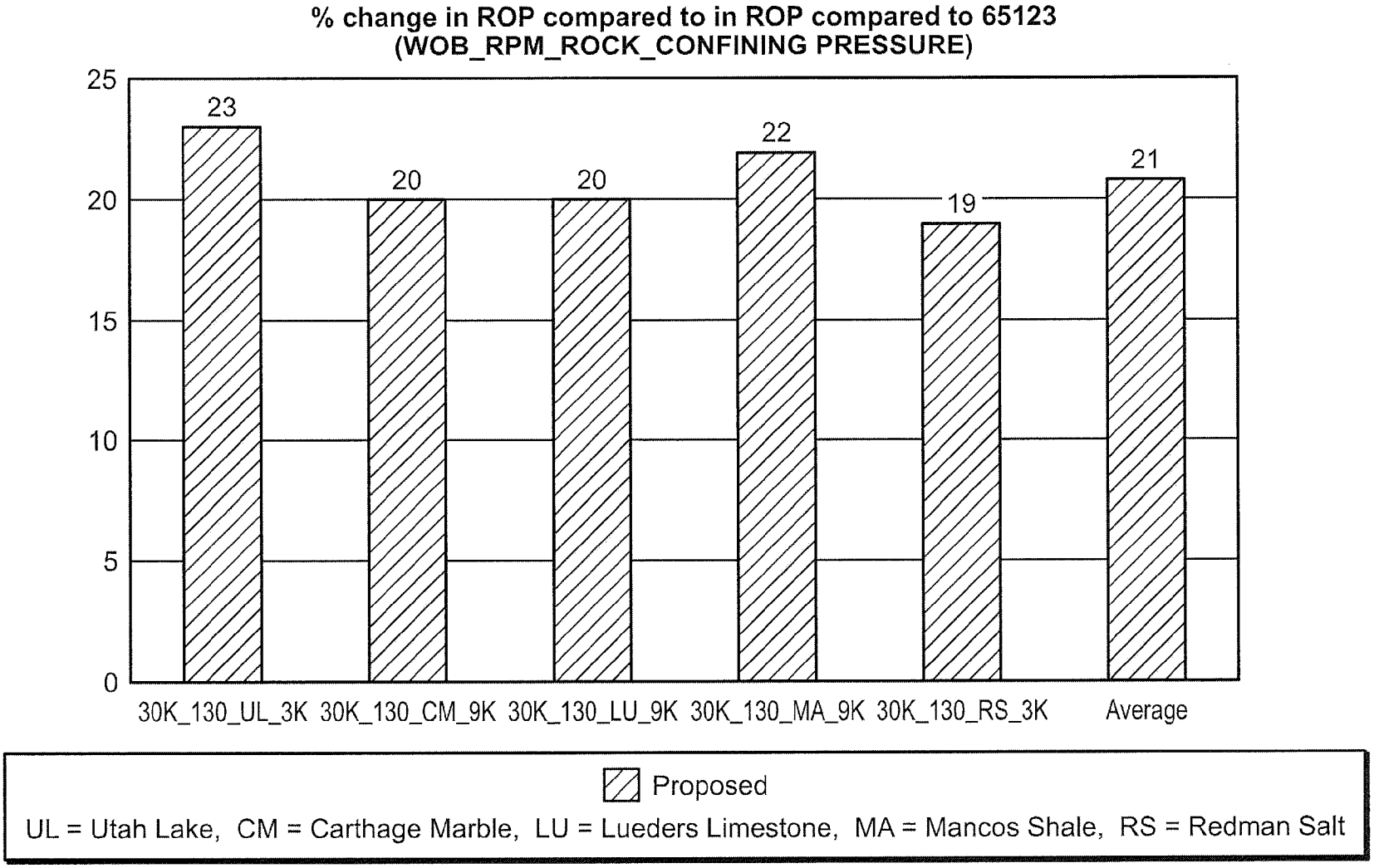
FIG. 17 shows a graphical representation of a percent change in ROP of a drill bit according to one or more embodiments of the present disclosure.

Referring now to FIG. 17, a graphical representation of a percent change in ROP of a drill bit according to one or more embodiments of the present disclosure is shown. Specifically, FIG. 17 shows a graphical representation of a percent change in ROP of PDC bit 700 according to one or more embodiments of the present disclosure. As shown, PDC bit 700 with core fragmentation feature including coring blade 717, first cutter 723, angled surface 1305, conical insert 727, and evacuation slot 721, as previously described in accordance with one or more embodiments of the present disclosure, exhibits an increase in ROP over a baseline PDC bit that does not have core fragmentation feature according to one or more embodiments of the present disclosure. More specifically, PDC bit 700 according to one or more embodiments of the present disclosure exhibits an average of a 21% increase in ROP over a baseline PDC bit with respect to a given weight on bit (WOB), RPM of drill string, type of rock, and confining pressure.

As appreciated by one of ordinary skill in the art, such an average increase in ROP is an unexpected result for PDC bit 700, which is configured to generate core sample fragments 725 simultaneously during drilling in accordance with one or more embodiments of the present disclosure as described above. This increase in ROP for PDC bit 700 according to one or more embodiments of the present disclosure may be advantageous at least because the increase in ROP translates to an increase in the service life of PDC bit 700, an ability to drill through formations faster, and a reduction in drilling costs.

Figure 18:
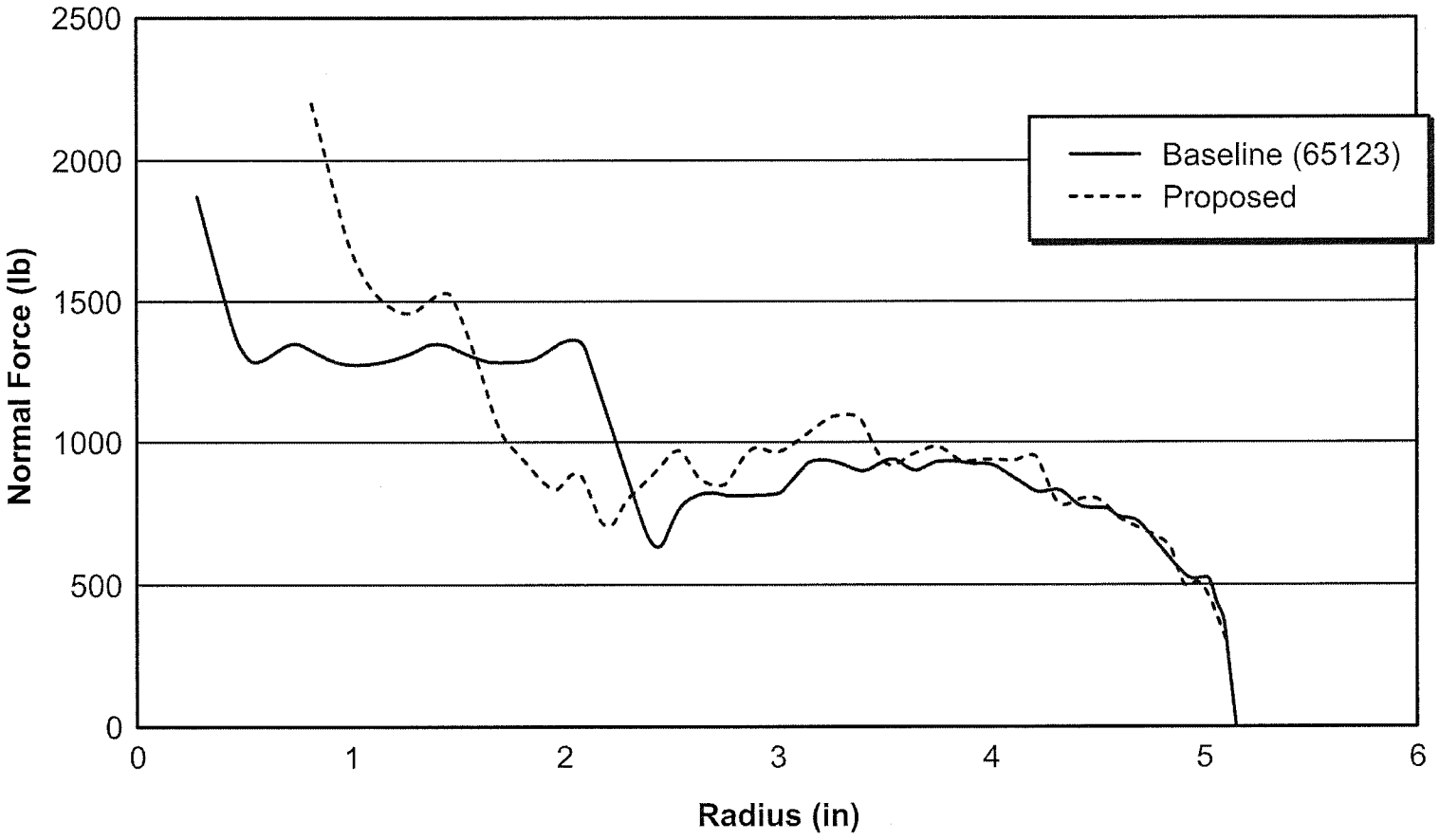
FIG. 18 shows a graphical representation of a normal force comparison of a drill bit according to one or more embodiments of the present disclosure.

Referring now to FIG. 18, a graphical representation of a normal force comparison of a drill bit according to one or more embodiments of the present disclosure is shown. Specifically, FIG. 18 shows a graphical representation of a normal force distribution as exerted on first cutter 723 of PDC bit 700 according to one or more embodiments of the present disclosure as compared to a baseline PDC bit, with respect to a given drill string RPM, WOB, and type of rock. As shown, when first cutter 723 of PDC bit 700 according to one or more embodiments of the present disclosure is disposed at a first radial position R1 that is about one inch away from bit centerline 709, first cutter 723 experiences a greater normal force than that of baseline PDC bit, where radial position of first cutter 723 is less than one inch away from (and is much closer to) bit centerline.

As appreciated by one of ordinary skill in the art, this greater normal force on first cutter 723 allows first cutter 723 to achieve a greater depth of cut per unit WOB. As further appreciated by one of ordinary skill in the art, this greater depth of cut per unit WOB results in an increased ROP of PDC bit 700. As previously described, an increase in ROP for PDC bit 700 according to one or more embodiments of the present disclosure may be advantageous at least because the increase in ROP may translate to an increase in the service life of PDC bit 700, an ability to drill through formations faster, and a reduction in drilling costs.

Figure 19:
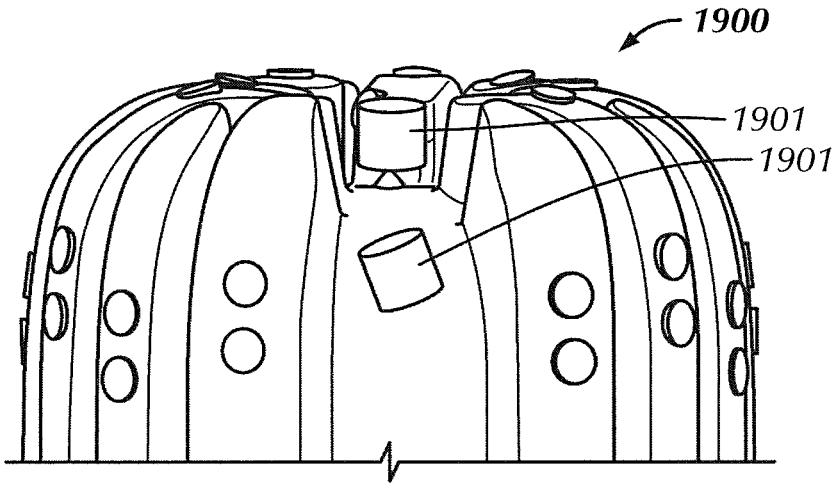
FIG. 19 shows a partial perspective view of a drill bit with core sample fragments according to one or more embodiments of the present disclosure.
Figure 20:
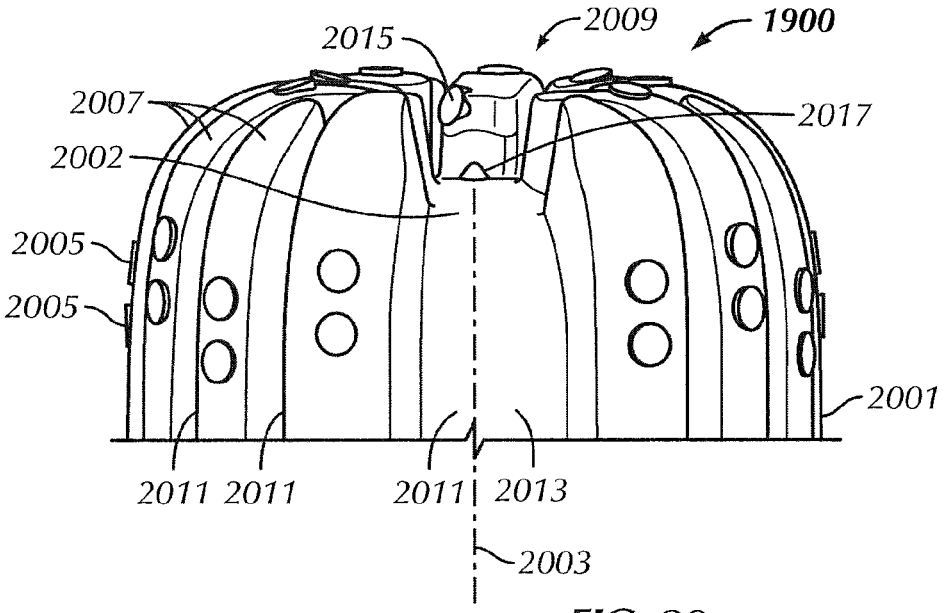
FIG. 20 shows the partial perspective view of the drill bit shown in FIG. 19 without core sample fragments according to one or more embodiments of the present disclosure.

Referring now to FIG. 19, a partial perspective view of a drill bit with core sample fragments according to one or more embodiments of the present disclosure is shown. Specifically, FIG. 19 shows a partial perspective view of impregnated bit 1900 with core sample fragments 1901 according to one or more embodiments of the present disclosure. Referring now to FIG. 20, the partial perspective view of impregnated bit 1900 according to one or more embodiments of the present disclosure as shown in FIG. 19 is shown without core sample fragments 1901 in order to provide an unobstructed partial perspective view of the structure of impregnated bit 1900.

As shown in FIG. 20, impregnated bit 1900 includes a bit body 2001 and a bit face 2002. Similar to PDC bit 700 as previously described, impregnated bit 1900 includes a pin (not shown) that is used to secure impregnated bit 1900 to the lower end of a drill string (not shown). Impregnated bit 1900 further includes a bit centerline 2003 about which impregnated bit 1900 rotates in a cutting direction. According to one or more embodiments of the present disclosure, bit face 2002 extends through bit centerline 2003 and smoothly transitions into and between channels 2011, which are described in further detail below.

When impregnated bit 1900 is secured to the drill string, rotating the drill string causes impregnated bit 1900 to rotate and penetrate and cut through a subterranean formation using a plurality of impregnated diamond particles and/or impregnated inserts 2005, which are described in further detail below. As impregnated bit 1900 penetrates and cuts through subterranean formation, a wellbore is formed.

As shown in FIG. 20, bit body 2001 supports a plurality of raised ribs 2007. Similar to plurality of blades 715 of PDC bit 700, according to one or more embodiments of the present disclosure, plurality of raised ribs 2007 include a raised volume of material that extends at a height from a face of bit body 2001. However, as appreciated by one of ordinary skill in the art, such "blades" on an impregnated drill bit are generally referred to in the art as "ribs." Plurality of raised ribs 2007 are formed on an end of impregnated bit 1900 that is opposite pin (not shown). As shown, plurality of raised ribs 2007 extend radially outward from bit centerline 2003, and then axially downward to define a diameter of impregnated bit 1900.

According to one or more embodiments of the present disclosure, one of the plurality of raised ribs 2007 is a coring rib 2009, which is described in further detail below. Plurality of raised ribs 2007 are separated by a plurality of channels 2011, which enable drilling fluid to flow between and both clean and cool plurality of raised ribs 2007 during drilling. According to one or more embodiments of the present disclosure, one of the plurality of channels 2011 is an evacuation slot 2013, which is described in further detail below.

As further shown in FIG. 20, each of plurality of raised ribs 2007 includes an impregnated cutting structure, through either diamond (or other superabrasive) particles impregnated in the ribs 2007 or a plurality of holes into which plurality of impregnated inserts 2005 are disposed. It is also within the scope of the present disclosure that plurality of raised ribs 2007 may include both diamond impregnation in the rib 2007 itself as well as impregnation in inserts 2005 fitted into holes formed in the raised ribs 2007. According to one or more embodiments of the present disclosure, plurality of holes are sized and shaped to receive corresponding plurality of impregnated inserts 2005. As shown, plurality of impregnated inserts 2005 may be arranged adjacent one another and/or spaced along plurality of raised ribs 2007. According to one or more embodiments of the present disclosure, plurality of impregnated inserts 2005 may be oriented to be substantially parallel to bit centerline 2003, or may be oriented to be substantially perpendicular to bit centerline 2003, depending on the position of plurality of impregnated inserts 2005 along plurality of raised ribs 2007. Plurality of impregnated inserts 2005 may be formed of natural or synthetic diamonds, as well as other non-superabrasive materials in order to achieve an abrasive cutting action while drilling a formation.

According to one or more embodiments of the present disclosure, coring rib 2009 has a first cutter (or first cutting element) 2015 disposed thereon. As described in further detail below, first cutter 2015 and coring rib 2009 work to form and break a core sample fragment 1901, such as that shown in FIG. 19.

As further shown in FIG. 20, impregnated bit 1900 includes a conical insert 2017 embedded in bit body 2001 and disposed on or proximate bit centerline 2003. As described in further detail below, conical insert 2017 works with coring rib 2009 to cause core sample fragment 1901 to break away from formation during drilling.

Figure 21:
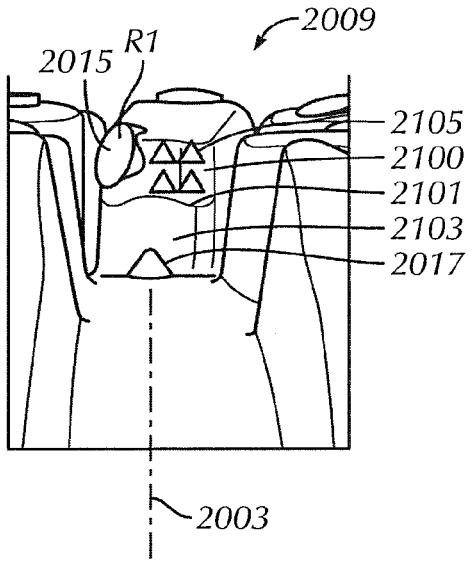
FIG. 21 shows a partial blown-up view of the drill bit shown in FIG. 20 according to one or more embodiments of the present disclosure.
Figure 22:
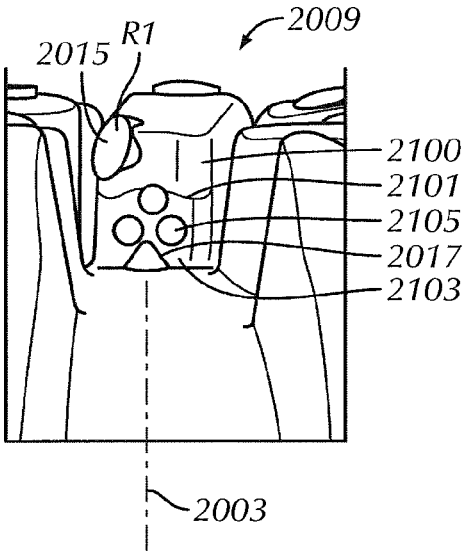
FIG. 22 shows another partial blown-up view of the drill bit shown in FIG. 20 according to one or more embodiments of the present disclosure.

As shown in FIG. 20, coring rib 2009 is one of plurality of raised ribs 2007 of impregnated bit 1900. Referring now to FIGS. 21-22, partial blown-up views of the impregnated bit 1900 shown in FIG. 20 according to one or more embodiments of the present disclosure are shown. Specifically, FIGS. 21-22 focus on coring rib 2009. As shown, according to one or more embodiments of the present disclosure, coring rib 2009 has first cutter 2015 disposed thereon. According to one or more embodiments of the present disclosure, first cutter 2015 is disposed on coring rib 2009 at a first radial position R1 from bit centerline 2003. First radial position R1 is determined by rotating all of the cutting elements of impregnated cutting structure into a single rotated view to produce a cutting profile. The cutting element located closest to the bit centerline 2003, i.e., at the first radial position R1, is the first cutter 2015.

In accordance with one or more embodiments of the present disclosure, first radial position R1 is located at some distance away from bit centerline 2003 to allow for the formation of a core sample fragment 1901. As a non-limiting example, according to one or more embodiments of the present disclosure, first radial position R1 is distanced from bit centerline 2003 at a distance that measures 0.25 times the diameter of impregnated bit 1900. According to one or more embodiments of the present disclosure, first radial position R1 may be distanced from bit centerline 2003 at a distance measuring in a range of 0.05 times the diameter of impregnated bit 1900 to 0.25 times the diameter of impregnated bit 1900. According to other embodiments of the present disclosure, first radial position R1 may be distanced from bit centerline 2003 at a distance measuring in a range having a lower limit of any of 0.05, 0.075, 0.1, 0.125, or 0.15 times the diameter of impregnated bit 1900 to an upper limit of any of 0.075, 0.1, 0.125, 0.15, 0.175, 0.2, 0.225, or 0.25 times the diameter of impregnated bit 1900, where any lower limit may be used in combination with any upper limit. As understood by one of ordinary skill in the art, first radial position R1 may be located at other distances away from bit centerline 2003, depending on the desired size of the core sample fragment 1901, without departing from the scope of the present disclosure.

According to one or more embodiments of the present disclosure, first cutter 2015 of coring rib 2009 is used to form core sample fragment 1901 at or near bit centerline 2003 of impregnated bit 1900 during drilling of wellbore. Specifically, first cutter 2015 cuts core sample fragment 1901 out of formation as impregnated bit 1900 rotates about bit centerline 2003 during drilling of wellbore. According to one or more embodiments of the present disclosure, first cutter 2015 may have a substantially planar cutting face. In other embodiments, first cutter 2015 may be a conical cutting element 3000 as further described below. The location of first radial position R1, at which first cutter 2015 is disposed, determines the resulting width or diameter of the core sample fragment 1901. For example, if first radial position R1 is located at a distance away from bit centerline 2003 that measures 0.25 times the diameter of impregnated bit 1900 in accordance with one or more embodiments of the present disclosure, first cutter 2015 disposed at first radial position R1 will form a core sample fragment 1901 having a radius that measures 0.25 times the diameter of impregnated bit 1900, an a width or diameter that measures 0.5 times the diameter of impregnated bit 1900. The further away first radial position R1 is from bit centerline 2003, the larger the width of the resulting core sample fragment 1901. Accordingly, as understood by one of ordinary skill in the art, first radial position R1 may be located various distances away from bit centerline 2003 in order to create core sample fragments 1901 having various widths without departing from the scope of the present disclosure.

As further shown in FIGS. 21-22, according to one or more embodiments of the present disclosure, coring rib 2009 may include substantially vertical surface 2100, relief 2101, and angled surface 2103. Angled surface 2103 is disposed axially above the blade top and axially below bit face 2002, which extends through bit centerline 2003. In some embodiments, bit face 2002 may have an insert inserted into a hole therein, which may be on or proximate bit centerline 2003. As shown, relief 2101 may be disposed between substantially vertical surface 2100 and angled surface 2103. Relief 2101 functions to relieve and protect substantially vertical surface 2100 from premature wear. According to one or more embodiments of the present disclosure, substantially vertical surface 2100, relief 2101, and angled surface 2103 are integrally connected to form a continuous piece, and are oriented to face bit centerline 2003 of impregnated bit 1900.

According to other embodiments of the present disclosure, coring rib 2009 may be configured without relief 2101. According to these other embodiments, substantially vertical surface 2100 and angled surface 2103 are integrally connected to form a continuous piece, and are oriented to face bit centerline 2003 of impregnated bit 1900. Further, according to these other embodiments, substantially vertical surface 2100 and angled surface 2103 intersect at a point that is axially above first cutter 2015 of coring rib 2009.

According to one or more embodiments of the present disclosure, substantially vertical surface 2100 may be substantially parallel to bit centerline 2003 of impregnated bit 1900. That is, according to one or more embodiments of the present disclosure, substantially vertical surface 2100 may be may be oriented such that substantially vertical surface 2100 is at an angle ranging from 0 to 5 degrees, in either direction, with respect to a line parallel to bit centerline 2003 of impregnated bit 1900. As better shown in FIG. 25, to be further described below, the slope of angled surface 2103 helps determine the length of resulting core sample fragment 1901. For example, the shallower the slope (i.e., the larger the degree of angle from bit centerline 2003) of angled surface 2103, the longer the length of resulting core sample fragment 1901. Likewise, the steeper the slope (i.e., the smaller the degree of angle from bit centerline 2003) of angled surface 2103, the shorter the length of resulting core sample fragment 1901. As understood by one of ordinary skill in the art, in addition to the slope of angled surface 2103, the height of coring rib 2009 also helps determine the length of the resulting core sample fragment 1901. For example, the taller the coring rib 2009, the longer the length of resulting core sample fragment 1901. Likewise, the shorter the coring rib 2009, the shorter the length of resulting core sample fragment 1901. Accordingly, as understood by one of ordinary skill in the art, angled surface 2103 may have an angle of various degrees from bit centerline 2003, and coring rib 2009 may have various heights in order to create core sample fragments 1901 having various lengths without departing from the scope of the present disclosure. In a particular embodiment, angled surface 2103 may by disposed such that the axial point at which angled surface 2103 has a radial value equal to the radial position of the first cutter 2015 may have a lower limit of any of at least 0.1, 0.2, 0.3, 0.4, or 0.5 times the diameter of the bit, and an upper limit of any of 0.2, 0.3, 0.4, 0.5, 0.6, or 0.75 times the diameter of the bit, where any lower limit can be used in combination with any upper limit.

According to one or more embodiments of the present disclosure, angled surface 2103 has an angle in a range of 15 degrees to 20 degrees from bit centerline 2003. However, in view of the above, this angle range is not intended to be limiting, and angled surface 2103 may have an angle of various degrees from bit centerline 2003. For example, in one or more embodiments, the angled surface may have a lower limit of any of about 5, 10, 15, 20, or 25 degrees, and an upper limit of any of 15, 20, 25, 30, 35, or 45 degrees. According to one or more embodiments of the present disclosure, angled surface 2103 may have an angle from bit centerline 2003 that allows angled surface 2103, in conjunction with substantially vertical surface 2100 and relief 2101, to exert a lateral load on a side of core sample fragment 1901 that is sufficient to cause core sample fragment 1901 to break away from formation after core sample fragment 1901 reaches a desired length. The function of angled surface 2103 in this regard is described further below with respect to FIG. 25.

Referring back to FIGS. 21-22, relief 2101 is disposed between substantially vertical surface 2100 and angled surface 2103. Relief 2101 allows substantially vertical surface 2100 and angled surface 2103 to transition between different slopes with respect to bit centerline 2003. According to one or more embodiments of the present disclosure, the location of relief 2101 between substantially vertical surface 2100 and angled surface 2103 is based upon the desired length to width ratio of the resulting core sample fragment 1901. According to one or more embodiments of the present disclosure, the ratio of the length of core sample fragment 1901 to the width of core sample fragment 1901 may be greater than or equal to one. As such, the location of relief 2101 of coring rib 2009 is determined based on the height of the coring rib 2009, the slope of angled surface 2103, and the location of first radial position R1 with respect to bit centerline 2003, as previously described above.

Referring to FIG. 21, according to one or more embodiments of the present disclosure, substantially vertical surface 2100 of coring rib 2009 may have a low friction abrasion resistant surface 2105 because of the load or loads that are exerted by and imposed upon substantially vertical surface 2100 during drilling. Use of low friction abrasion resistant surface 2105 may provide abrasion protection for substantially vertical surface 2100, which enhances the service life of impregnated bit 1900. According to one or more embodiments of the present disclosure, use of low friction abrasion resistant surface 2105 on substantially vertical surface 2100 may also provide additional cutting action during formation of core sample fragment 1901. According to one or more embodiments of the present disclosure, low friction abrasion resistant surface 2105 may either be integral with substantially vertical surface 2100, or may be formed from one or more non-integral pieces, such as the triangles shown in FIG. 21, for example. Although triangle-shaped non-integral pieces are shown in FIG. 21, one of ordinary skill in the art would understand that one or more embodiments of the present disclosure are not limited to non-integral pieces of a particular shape. Indeed, squares, circles, ovals, diamonds, discs, wedges, or any other shape that is capable of providing abrasion protection to substantially vertical surface 2100 may be used.

According to one or more embodiments of the present disclosure, low friction abrasion resistant surface 2105 is integral with substantially vertical surface 2100 and is formed during formation of coring rib 2009 of impregnated bit 1900. According to one or more embodiments of the present disclosure, the material used for low friction abrasion resistant surface may be either TSP, natural diamond, or any other type of thermally stable abrasion resistant material. According to one or more embodiments of the present disclosure, the material used for low friction abrasion resistant surface 2105 is TSP.

Referring to FIG. 22, according to one or more embodiments of the present disclosure, angled surface 2103 of coring rib 2009 may have a low friction abrasion resistant surface 2105 because of the load or loads that are exerted by and imposed upon angled surface 2103 during drilling. Use of low friction abrasion resistant surface 2105 provides abrasion protection for angled surface 2103, which ensures durability from wear, thereby enhancing the service life of impregnated bit 1900. According to one or more embodiments of the present disclosure, low friction abrasion resistant surface 2105 may either be integral with angled surface 2103, or may be formed from one or more non-integral pieces, such as the discs shown in FIG. 22, for example. Although disc-shaped non-integral pieces are shown in FIG. 22, one of ordinary skill in the art would understand that one or more embodiments of the present disclosure are not limited to non-integral pieces of a particular shape. Indeed, triangles, squares, circles, ovals, diamonds, wedges, or any other shape that is capable of providing abrasion protection to angled surface 2103 may be used.

According to one or more embodiments of the present disclosure, low friction abrasion resistant surface 2105 is integral with angled surface 2103 and is formed during formation of coring rib 2009 of impregnated bit 1900. According to one or more embodiments of the present disclosure, the material used for low friction abrasion resistant surface 2105 may be either TSP, natural diamond, or any other type of thermally stable abrasion resistant material. According to one or more embodiments of the present disclosure, the material used for low friction abrasion resistant surface 2105 is TSP.

FIGS. 21-22 also show conical insert 2017 disposed on or proximate bit centerline 2003. As used herein, "proximate" with respect to the bit centerline 2003 means either on bit centerline 2003 or between bit centerline 2003 and first radial position R1. According to one or more embodiments of the present disclosure, conical insert 2017 is embedded in bit body 2001 such that an apex of conical insert 2017 is positioned axially above relief 2101 of coring rib 2009. Conical insert 2017 is described in further detail below with respect to FIG. 23.

Figure 23:
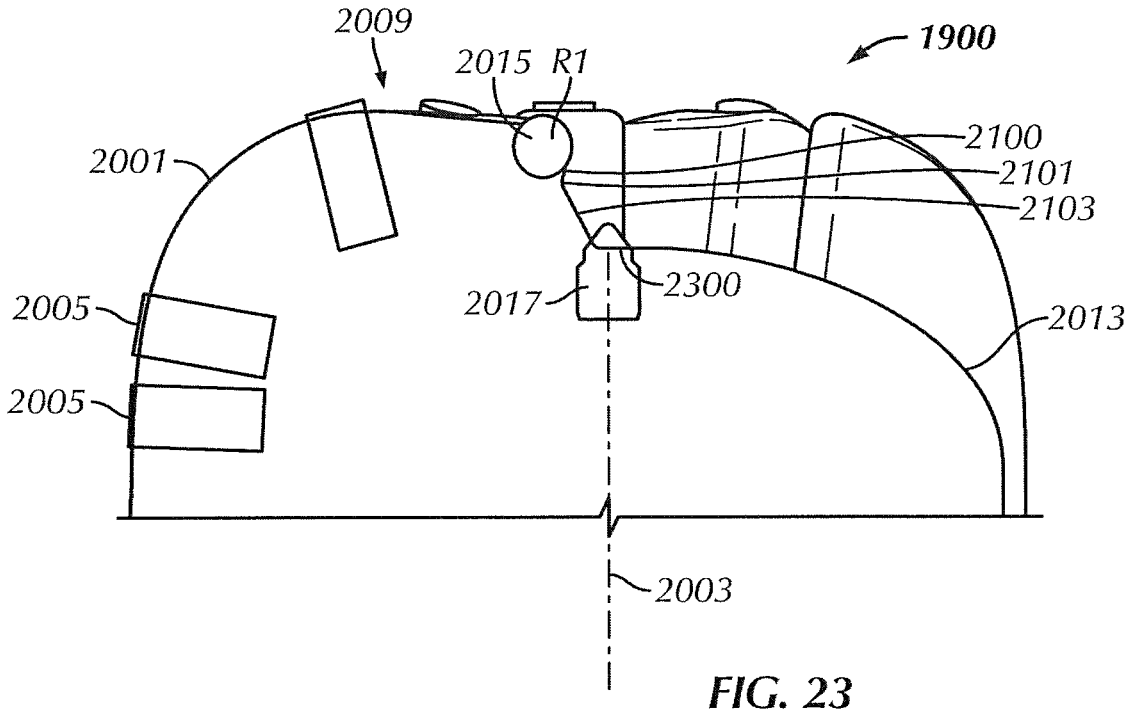
FIG. 23 shows a cross-sectional view of a drill bit according to one or more embodiments of the present disclosure.

Referring now to FIG. 23, a cross-sectional view of a drill bit according to one or more embodiments of the present disclosure is shown. Specifically, FIG. 23 shows a cross-sectional view of impregnated bit 1900 according to one or more embodiments of the present disclosure. As shown, conical insert 2017 is disposed on or proximate bit centerline 2003 at support surface 2300 of bit body 2001. According to one or more embodiments of the present disclosure, support surface 2300 is disposed between coring rib 2009 and evacuation slot 2013 of impregnated bit 1900. According to one or more embodiments of the present disclosure, support surface 2300 integrally connects coring rib 2009 to evacuation slot 2013 in a continuous piece. Further, according to one or more embodiments of the present disclosure, support surface 2300 has a slope of less than 5 degrees, less than 3 or 2 degrees in other embodiments, or may even have a slope of zero with respect to bit centerline 2003.

Still referring to FIG. 23, according to one or more embodiments of the present disclosure conical insert 2017 is embedded in bit body 2001 such that an apex of conical insert 2017 is positioned axially above relief 2101 of coring rib 2009. According to one or more embodiments of the present disclosure, conical insert 2017 of impregnated bit 1900 has the same shape, structural, compositional, dimensional, and functional characteristics of conical insert 727 of PDC bit 700, as previously described above.

Still referring to FIG. 23, evacuation slot 2013 is shown positioned directly across bit centerline 2003 relative to coring rib 2009. According to one or more embodiments of the present disclosure, a profile of evacuation slot 2013 is recessed below bit body 2001 of impregnated bit 1900. As understood by one of ordinary skill in the art, the amount that evacuation slot 2013 is recessed below bit body 2001 may vary without departing from the scope of the present disclosure. For example, as appreciated by one of ordinary skill in the art, evacuation slot 2013 may be recessed below bit body 2001 by an amount that is sufficient to ensure a smooth exit of core sample fragment 1901 from evacuation slot 2013 in order to avoid bit plugging. Further, as appreciated by one of ordinary skill in the art, evacuation slot 2013 may be recessed below bit body 2001 by an amount that does not compromise the blank strength of impregnated bit 1900. Therefore, according to one or more embodiments of the present disclosure, evacuation slot 2013 is recessed below bit body 2001 of impregnated bit 1900 by an amount that allows smooth exit of core sample fragment 1901 without bit plugging, and by an amount that does not adversely affect the service life of impregnated bit 1900. According to one or more embodiments of the present disclosure, evacuation slot 2013 has a generally downward slope with respect to support surface 2300 and bit body 2001.

Further, in one or more embodiments, channel 2011 in which evacuation slot 2013 is located comprises a greater circumferential extent of impregnated bit 1900 than other channels 2011. For example, in one or more embodiments, the channel 2011 in which evacuation slot 2013 is located comprises at least a greater than 50% surface area than the other channels 2011. In other embodiments, the channel 2011 in which evacuation slot 2013 is located comprises at least a greater than 75%, greater than 100%, or even greater than 150% surface area than the other channels 2011. Further, depending on the profile of the bit body 2001, it may not be necessary to provide an evacuation slot 2013 recessed into the bit body 2001, but the slope of the channel 2011 combined with the surface area of the channel 2011 opposite the coring rib 2009 may be sufficient to result in evacuation of the core sample fragment 1901 from the bit body 2001 into the annulus to be circulated to the surface.

Figure 24:
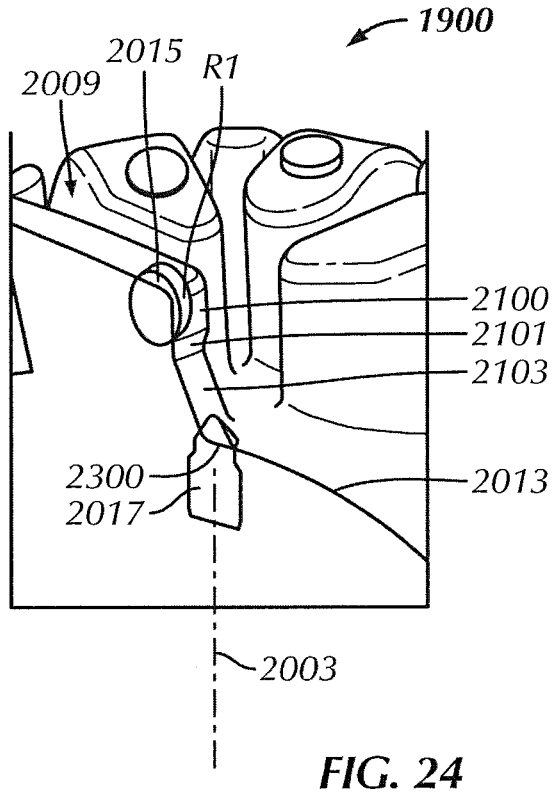
FIG. 24 shows a perspective cross-sectional view of a drill bit according to one or more embodiments of the present disclosure.

Referring now to FIG. 24, a perspective cross-sectional view of a drill bit according to one or more embodiments of the present disclosure is shown. Specifically, FIG. 24 shows a perspective cross-sectional view of impregnated bit 1900 according to one or more embodiments of the present disclosure. As shown, impregnated bit 1900 includes, bit centerline 2003, coring rib 2009, evacuation slot 2013, first cutter 2015, first radial position R1, conical insert 2017, angled surface 2103, substantially vertical surface 2100, relief, 2101, angled surface 2103, and support surface 2300. The interaction of these components with respect to forming, breaking, and evacuating core sample fragment 1901 is further described below with respect to FIG. 25.

Figure 25:
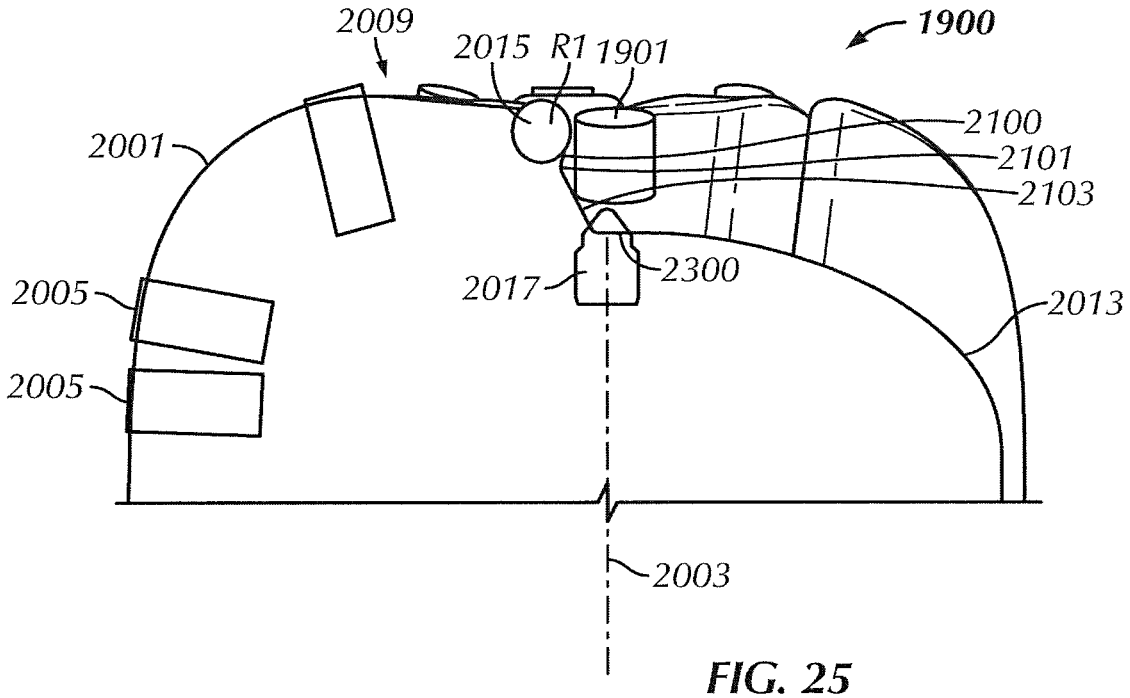
FIG. 25 shows the cross-sectional view of the drill bit shown in FIG. 23 with a core sample fragment according to one or more embodiments of the present disclosure.

Referring now to FIG. 25, the cross-sectional view of the impregnated bit 1900 shown in FIG. 23 with a core sample fragment according to one or more embodiments of the present disclosure is shown. As previously described, according to one or more embodiments of the present disclosure, first cutter 2015 of coring rib 2009 is used to form core sample fragment 1901 during drilling of wellbore. Specifically, first cutter 2015 cuts core sample fragment 1901 out of formation as impregnated bit 1900 rotates about bit center line 2003 during drilling of wellbore. Accordingly, core sample fragment 1901 is formed at bit centerline 2003 by cutting action of first cutter 2015.

Once core sample fragment 1901 reaches a particular length, which is determined by height of coring rib 2009 and angle of angled surface 2103 with respect to bit centerline 2003 as previously described above, angled surface 2103 of coring rib 2009 facilitates the break of core sample fragment 1901 from the formation by exerting a lateral load on one side of the newly formed core sample fragment 1901. According to one or more embodiments of the present disclosure, this side-loading causes core sample fragment 1901 to break away from formation at an end of core sample fragment 1901 that is adjacent to formation. The end of core sample fragment 1901 that is adjacent formation is the weakest area of core sample fragment 1901 due to stresses imparted thereon during formation of core sample fragment 1901 by first cutter 2015. Accordingly, side-loading by angled surface 2103 causes core sample fragment 1901 to break away from formation at the end of core sample fragment 1901 that is adjacent formation, in accordance with one or more embodiments of the present disclosure.

According to one or more embodiments of the present disclosure, the resulting core sample fragment 1901 has a width in a range of 0.75 inches to 1.25 inches, and a length in a range of 0.75 inches to 1.25 inches. As understood by one of ordinary skill in the art, resulting core sample fragment 1901 may have various lengths and widths without departing from the scope of the present disclosure.

As further shown in FIG. 25, according to one or more embodiments of the present disclosure, the point at which newly formed core sample fragment 1901 contacts angled surface 2103 of coring rib 2009 is axially below the apex of conical insert 2017. Stated another way, according to one or more embodiments of the present disclosure, newly formed core sample fragment 1901 hits angled surface 2103 at a point that is at the same radial position as first radial position R1 of first cutter 2015. This point is axially below the apex of conical insert 2017 according to one or more embodiments of the present disclosure.

According to other embodiments of the present disclosure, first cutter 2015 of impregnated bit 1900 may be a conical cutting element 3000 as previously described above with reference to PDC bit 700 as shown in FIG. 30. In these other embodiments, conical cutting element 3000 may be embedded in coring rib 2009 at first radial position R1 such that an apex of conical cutting element 3000 is oriented toward bit centerline 2003. Further, in these other embodiments, once core sample fragment 1901 reaches a particular length, which is determined by the height of coring rib 2009 as previously described above, conical cutting element 3000 creates a score the newly formed core sample fragment 1901 during drilling. According to one or more embodiments of the present disclosure, this scoring causes core sample fragment 1901 to weaken and break away from the formation at an end of core sample fragment 1901 that is adjacent to formation. The end of core sample fragment 1901 that is adjacent formation is the weakest area of core sample fragment 1901 due to stresses imparted thereon during formation of core sample fragment 1901 by cutting action of conical cutting element 3000 acting as first cutter 2015. Accordingly, scoring by conical cutting element 3000 causes core sample fragment 1901 to break away from formation at the end of core sample fragment 1901 that is adjacent formation, in accordance with one or more embodiments of the present disclosure.

Embodiments having a conical cutting element 3000 as the first radial cutting element may use conical cutting elements

3000 having a radius ranging from 0.010 to 0.125 inches in particular embodiments. In some embodiments, the radius r of the conical cutting element 3000 at the first radial position R1 may range from a lower limit of any of 0.01, 0.02, 0.04, 0.05, 0.06, or 0.075 inches, and an upper limit of any of 0.05, 0.06, 0.075, 0.085, 0.10, or 0.0125 inches, where any lower limit may be used in combination with any upper limit. Additionally, particular embodiments may use an asymmetrical or oblique cutting element where a cutting conical cutting end portion of the conical cutting element 3000 has an axis that is not coaxial with the axis of the substrate. Further, it may also be desirable to place the conical cutting element 3000 at a particular rake orientation (i.e., vertical or lateral orientation) on the coring rib 2009 (for the given degree of asymmetry as well as cone angle for the particular conical cutting element 3000) such that there is an angle $\alpha$ formed between the most radially interior portion of the conical cutting element 3000 and a line parallel to the bit centerline 709. In various embodiments, a may range from 0 to 45 degrees. In other embodiments, an angle $\alpha$ may be greater than 0 degrees. In some embodiments, the angle $\alpha$ may range from a lower limit of any of greater than 0, 2, 5, 10, 15, 20, or 30 degrees to an upper limit of any of 15, 20, 25, 30, 35, 40, or 45 degrees, where any lower limit may be used in combination with any upper limit. Advantageously, placement of a conical cutting element 3000 at the first radial position R1 of the coring rib 2009 may allow for weakening on the core strength of the core sample fragment 1901 formed in the center region of impregnated bit 1900 by allowing for the conical cutting element 3000 to create a score therein. Further, according to one or more embodiments of the present disclosure, coring rib 2009 having conical cutting element 3000 at first radial position R1 may be configured with or without angled surface 2103 as previously described above.

In the event that the lateral load exerted by angled surface 2103 (or, according to other embodiments, scoring by a conical cutting element 3000 embedded in coring rib 2009 as previously described above) is insufficient to break core sample fragment 1901 away from formation, a conical insert 2017 embedded proximate bit centerline 2003 may function to cause core sample fragment 1901 to break away from formation as a back-up. Specifically, according to one or more embodiments of the present disclosure, conical insert 2017 embedded proximate bit centerline 2003 exerts a central load on the end of core sample fragment 1901 that is closest to the apex of conical insert 2017. The central load exerted by conical insert 2017 causes core sample fragment 1901 to fracture or crack. As a result of this central load and because conical insert 2017 is disposed on or proximate bit centerline 2003, core sample fragment 1901 breaks into two halves. According to one or more embodiments of the present disclosure, these two halves are substantially equal in length and width.

After core sample fragment 1901 is broken away from formation in accordance with one or more embodiments of the present disclosure, bit hydraulics (as previously described above with respect to PDC bit 700) helps newly extracted core sample fragment 1901 to be relayed toward evacuation slot 2013 for exit of impregnated bit 1900. Alternatively, as previously described with respect to PDC bit 700, impregnated bit 1900 may employ a bridge portion, the mechanical structure of which creates a boundary to help direct newly extracted core sample fragment 1901 toward evacuation slot 2013 for exit of impregnated bit 1900.

As previously described, the general downward slope of evacuation slot 2013 in accordance with one or more embodiments of the present disclosure may enable core sample fragment 1901 to exit impregnated bit 1900 without bit plugging. According to one or more embodiments of the present disclosure, from evacuation slot 2013, core sample fragment 1901 is transported to the surface of the formation via an annulus (not shown) that is formed between the wellbore and the drill string. In other embodiments, as previously described, it may not be necessary to provide an evacuation slot 2013 recessed into the bit body 2001. According to these other embodiments, the slope of the channel 2011 combined with the surface area of the channel 2011 opposite the coring rib 2009 may be sufficient to result in evacuation of the core sample fragment 1901 from the bit body 2001 without bit plugging, and into the annulus to be circulated to the surface.

Figure 26A:
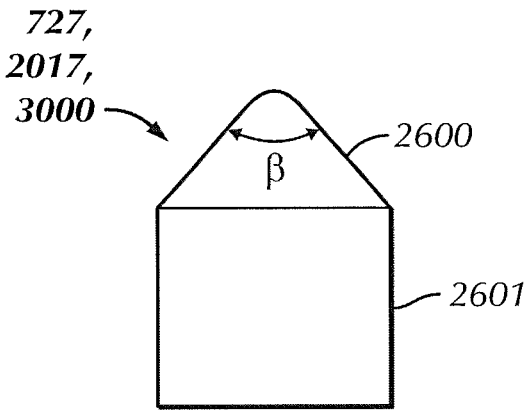
FIGS. 26A-C show various conical inserts or conical cutting elements according to one or more embodiments of the present disclosure.
Figure 26B:
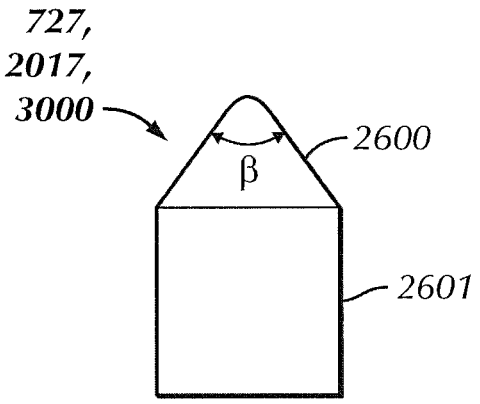
Figure 26C:
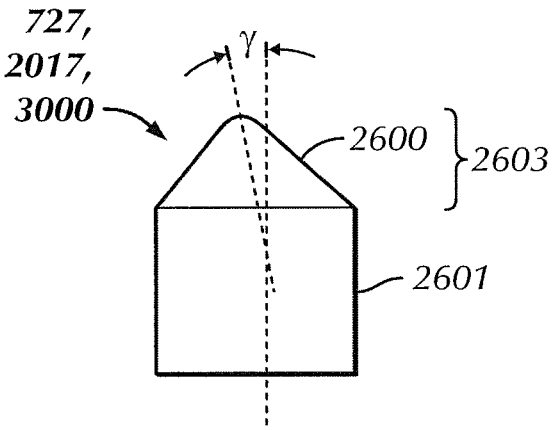

Referring now to FIGS. 26A-C, variations of conical inserts 727, 2017 or conical cutting elements 3000 that may be in any of the embodiments disclosed herein are shown. The conical inserts 727, 2017 or conical cutting elements 3000 (variations of which are shown in FIGS. 26A-C) provided on a drill bit possess a diamond layer 2600 on a substrate 2601 (such as a cemented tungsten carbide substrate), where the diamond layer 2600 forms a conical diamond working surface. Specifically, the conical geometry may comprise a side wall that tangentially joins the curvature of the apex. Conical inserts 727, 2017 or conical cutting elements 3000 may be formed in a process similar to that used in forming diamond enhanced inserts (used in roller cone bits) or by brazing of components together. The interface (not shown separately) between diamond layer 2600 and substrate 2601 may be non-planar or non-uniform, for example, to aid in reducing incidents of delamination of the diamond layer 2600 from substrate 2601 when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip region of the layer. Further, it may desirable to create the interface geometry such that the diamond layer is thickest at a critical zone that encompasses the primary contact zone between the diamond enhanced element and the formation. Additional shapes and interfaces that may be used for the diamond enhanced elements of the present disclosure include those described in U.S. Patent Publication No. 2008/0035380, which is herein incorporated by reference in its entirety. Further, the diamond layer 2600 may be formed from any polycrystalline superabrasive material, including, for example, polycrystalline diamond, polycrystalline cubic boron nitride, thermally stable polycrystalline diamond (formed either by treatment of polycrystalline diamond formed from a metal such as cobalt or polycrystalline diamond formed with a metal having a lower coefficient of thermal expansion than cobalt).

The apex of the conical inserts 727, 2017 or conical cutting elements 3000 may have curvature, including a radius of curvature. In this embodiment, the radius of curvature may range from about 0.050 to 0.125 inches. In some embodiments, the curvature may comprise a variable radius of curvature, a portion of a parabola, a portion of a hyperbola, a portion of a catenary, or a parametric spline. Further, referring to FIGS. 26A-B, the cone angle $\beta$ of the conical end may vary, and be selected based on the particular formation to be drilled. In a particular embodiment, the cone angle $\beta$ may range from about 75 to 90 degrees.

Figure 27:
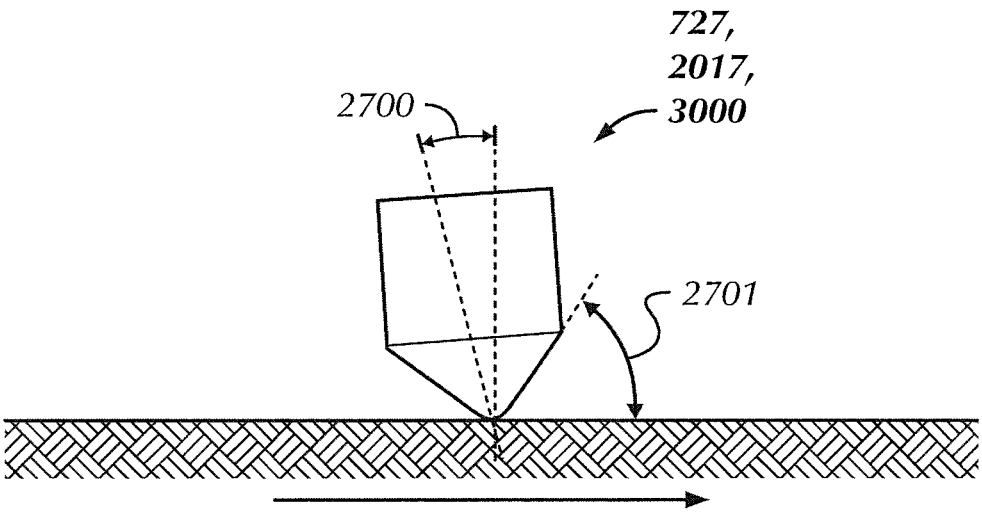
FIG. 27 shows an embodiment of a conical insert or conical cutting element according to the present disclosure.

Referring now to FIG. 26C, an asymmetrical or oblique conical insert or conical cutting element according to one or more embodiments of the present disclosure is shown. As shown in FIG. 26C, the cutting conical cutting end portion 2603 of the conical insert 727, 2017 or conical cutting element 3000 has an axis that is not coaxial with the axis of the substrate 2601. In a particular embodiment, at least one asymmetrical conical insert 727, 2017 or conical cutting element 3000 may be used on any of the described drill bits. Selection of an asymmetrical conical insert 727, 2017 or conical cutting element 3000 may be selected to better align a normal or reactive force on the conical insert 727, 2017 or conical cutting element 3000 from the formation with the cutting tip axis or to alter the aggressiveness of the conical insert 727, 2017 or conical cutting element 3000 with respect to the formation. In a particular embodiment, the angle γ formed between the cutting end or cone axis and the axis of the substrate may range from 37.5 to 45 degrees, with the angle on trailing side being greater, by 5-20 degrees more than leading angle. Referring now to FIG. 27, the back rake 2700 of an asymmetrical (i.e., oblique) conical insert 727, 2017 or conical cutting element 3000 is based on the axis of the conical cutting end, which does not pass through the center of the base of the conical cutting end. As shown, the strike angle 2701 is based on the angle between the leading portion of the side substantially vertical surface of the conical insert 727, 2017 or conical cutting element 3000 and the formation. As shown in FIG. 27, the cutting end axis through the apex is directed away from the direction of the rotation of the bit.

Figure 28A:
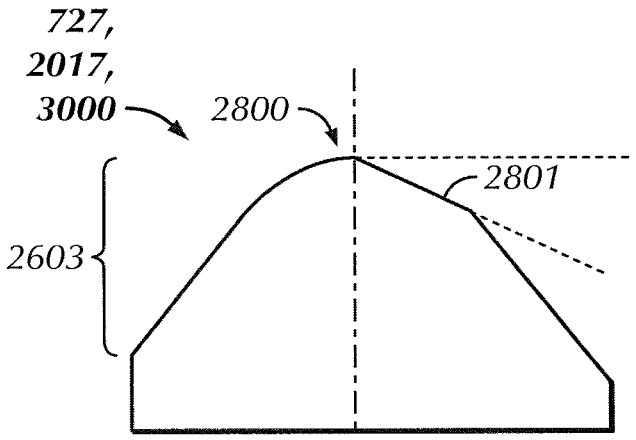
FIGS. 28A-C show various conical inserts or conical cutting elements according to one or more embodiments of the present disclosure.
Figure 28B:
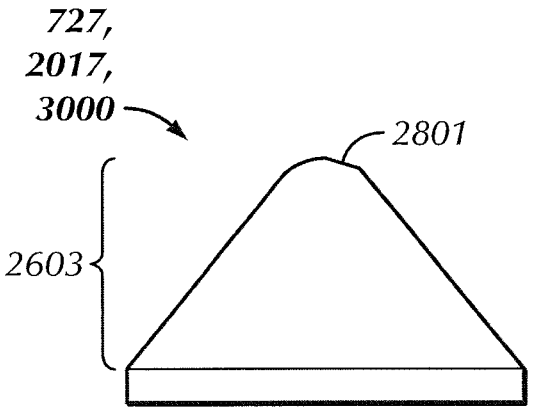
Figure 28C:
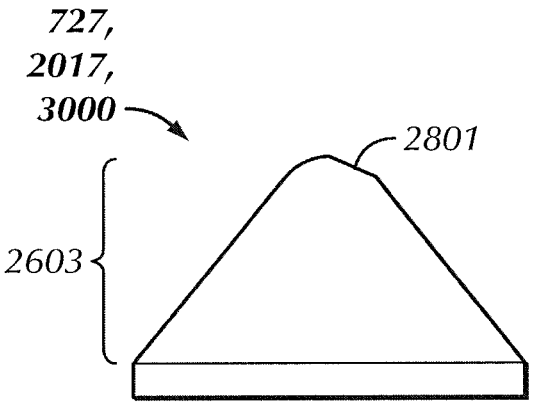

Referring to FIGS. 28A-C, a portion of the conical insert 727, 2017 or conical cutting element 3000, adjacent the apex 2800 of the cutting end 2603, may be beveled or ground off of the cutting element to form a beveled surface 2801 thereon. For example, the slant cut angle of the bevel may be measured from the angle between the beveled surface and a plane normal to the apex of the conical insert 727, 2017 or conical cutting element 3000. Depending on the desired aggressiveness, the slant cut angle may range from 15 to 30 degrees. As shown in FIGS. 28B and 28C, slant cut angles of 17 degrees and 25 degrees are shown. Further, the length of the bevel may depend, for example, on the slant cut angle, as well as the apex angle.

Figure 29:
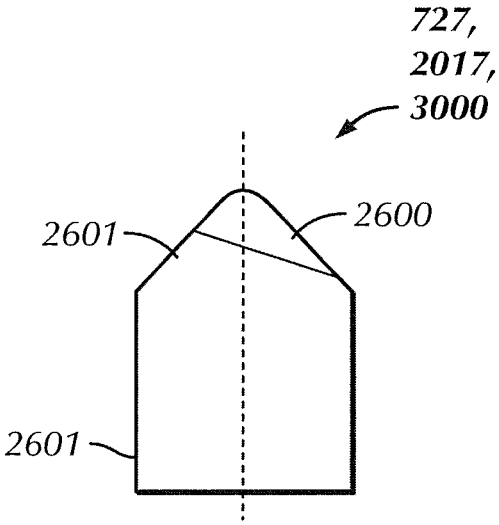
FIG. 29 shows an embodiment of a conical insert or conical cutting element according to one or more embodiments of the present disclosure.

In addition to or as an alternative to a non-planar interface between the diamond layer 2600 and the carbide substrate 2601 in the conical insert 727, 2017 or conical cutting element 3000, a particular embodiment of the conical insert 727, 2017 or conical cutting element 3000 may include an interface that is not normal to the substrate body axis, as shown in FIG. 29, to result in an asymmetrical diamond layer. Specifically, in such an embodiment, the volume of diamond on one half of the conical insert 727, 2017 or conical cutting element 3000 is greater than that of the other half of the conical insert 727, 2017 or conical cutting element 3000. The selection of the angle of the interface with respect to the base may be selected, for example, based on the particular back rake, strike angle, apex angle, axis for the conical cutting end, and to minimize the amount of shear forces on the diamond-carbide interface and instead put the interface into greater compression stress than shear stress.

Embodiments of the present disclosure may include one or more of the following advantages. Embodiments of the present disclosure may provide for fixed cutter drill bits, such as PDC bits and impregnated bits, that are capable of forming and extracting core sample fragments from a formation simultaneously during drilling, and continuously as drilling progresses. Because embodiments of the present disclosure are capable of forming and extracting core sample fragments from a formation simultaneously during drilling, tripping the drill string, which is time consuming and expensive, may be avoided. Embodiments of the present disclosure are capable of forming core sample fragments that are of a better quality than other drill cuttings that travel uphole through the annulus. Accordingly, embodiments of the present disclosure are capable of forming core sample fragments that may provide meaningful testing and analysis of geological characteristics of the formation from which the core sample fragments were extracted. Embodiments of the present disclosure may provide for fixed cutter drill bits designed with an evacuation slot in accordance with one or more embodiments of the present disclosure that facilitates the exit of core sample fragments from the drill bit to the annulus without any risk of bit plugging. Apart from extracting quality core sample fragments from a formation, fixed cutter drill bits according to one or more embodiments of the present disclosure also exhibit an increase in ROP, which translates to an increase in the service life of fixed cutter drill bit, an ability to drill through formations faster, and a reduction in drilling costs.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit for obtaining core sample fragments from a subterranean formation, the drill bit comprising:

a bit body having a bit centerline and a bit face;

a plurality of blades extending radially along the bit face and separated by a plurality of flow courses therebetween, wherein one of the plurality of blades is a coring blade comprising:

a substantially vertical surface; and an angled surface, wherein the substantially vertical surface and the angled surface are integrally connected forming a continuous surface; and a plurality of cutting elements disposed on the plurality of blades, wherein one of the plurality of cutting elements is a first cutting element disposed on the coring blade at a first radial position from the bit centerline, wherein one of the plurality of flow courses is an evacuation slot that is positioned across the bit centerline relative to the coring blade; wherein the flow courses and the evacuation slot extend to the same depth into the surface of the bit body.

2. The drill bit according to claim 1, the coring blade further comprising:

a relief disposed between the substantially vertical surface and the angled surface, wherein the substantially vertical surface, the angled surface, and the relief are integrally connected.

3. The drill bit according to claim 1, wherein a support surface is disposed between the angled surface of the coring blade and the evacuation slot, and integrally connects the angled surface to the evacuation slot.

4. The drill bit according to claim 3, wherein a conical insert is disposed at the support surface at one of the bit centerline, or between the bit centerline and the first radial position, and wherein the conical insert is embedded in the bit body such that an apex of the conical insert is positioned axially above an intersection of the substantially vertical surface and the angled surface.

5. The drill bit according to claim 1, wherein the first radial position of the first cutting element is distanced from the bit centerline at a distance having a measurement in a range of 0.05 times a diameter of the drill bit to 0.25 times the diameter of the drill bit.

6. The drill bit according to claim 1, wherein the substantially vertical surface of the coring blade and the angled surface of the coring blade each comprise a low friction abrasion resistant material, and wherein the low friction abrasion resistant material of the substantially vertical surface is capable of cutting.

7. The drill bit according to claim 6, wherein the low friction abrasion resistant material is thermally stable polycrystalline diamond (TSP).

8. The drill bit according to claim 1, wherein the angled surface of the coring blade has an angle in a range of 15° to 20° from the bit centerline.

9. The drill bit according to claim 1, wherein centrally located adjacent end portions of at least two of the plurality of blades are connected together via a bridge portion.

10. The drill bit according to claim 9, wherein one of the at least two of the plurality of blades is the coring blade.

11. The drill bit according to claim 1, wherein the plurality of cutting elements comprises diamond impregnated particles.

12. The drill bit according to claim 1, wherein the plurality of cutting elements comprises diamond impregnated inserts.

13. The drill bit according to claim 1, wherein the plurality of cutting elements comprises one or more of:

cutters having a substantially planar cutting face;

conical cutting elements; and rotatable cutting elements.

14. A drill bit for obtaining core sample fragments from a subterranean formation, the drill bit comprising:

a bit body having a bit centerline and a bit face;

a plurality of blades extending radially along the bit face and separated by a plurality of flow courses therebetween, wherein one of the plurality of blades is a coring blade, wherein one of the plurality of flow courses is an evacuation slot that is positioned across the bit centerline relative to the coring blade; and a plurality of cutting elements disposed on the plurality of blades, wherein one of the plurality of cutting elements is a first cutting element disposed on the coring blade at a first radial position from the bit centerline, wherein the first cutting element is a conical cutting element embedded in the coring blade such that an apex of the conical cutting element is oriented toward the bit centerline, wherein a support surface is disposed between the coring blade and the evacuation slot, and integrally connects the coring blade to the evacuation slot, wherein a conical insert is disposed proximate the bit centerline at the support surface, and wherein the conical insert is embedded in the bit body such that an apex of the conical insert is positioned axially above the first radial position of the first cutting element.

15. The drill bit according to claim 14, wherein a profile of the evacuation slot is recessed below the bit body.

16. The drill bit according to claim 14, wherein the first radial position of the first cutting element is distanced from the bit centerline at a distance having a measurement in a range of 0.05 times a diameter of the drill bit to 0.25 times the diameter of the drill bit.

17. The drill bit according to claim 14, wherein centrally located adjacent end portions of at least two of the plurality of blades are connected together via a bridge portion.

18. The drill bit according to claim 17, wherein one of the at least two of the plurality of blades is the coring blade.

19. The drill bit according to claim 14, wherein the plurality of cutting elements comprises diamond impregnated particles.

20. The drill bit according to claim 14, wherein the plurality of cutting elements comprises diamond impregnated inserts.

21. The drill bit according to claim 14, wherein the plurality of cutting elements comprises one or more of:

cutters having a substantially planar cutting face;

conical cutting elements; and rotatable cutting elements.

22. The drill bit according to claim 14, wherein the coring blade comprises:

a substantially vertical surface; and an angled surface, wherein the substantially vertical surface and the angled surface are integrally connected.

23. The drill bit according to claim 22, wherein the substantially vertical surface of the coring blade and the angled surface of the coring blade each comprise a low friction abrasion resistant material, and wherein the low friction abrasion resistant material of the substantially vertical surface is capable of cutting.

24. The drill bit according to claim 23, wherein the low friction abrasion resistant material is thermally stable polycrystalline diamond (TSP).

25. The drill bit according to claim 22, wherein the angled surface of the coring blade has an angle in a range of 15° to 20° from the bit centerline.

26. The drill bit according to claim 22, the coring blade further comprising:

a relief disposed between the substantially vertical surface and the angled surface, wherein the substantially vertical surface, the angled surface, and the relief are integrally connected.

27. A method of obtaining core sample fragments from a subterranean formation, the method comprising:

securing the drill bit according to claim 1 to a lower end of a drill string, wherein one of the plurality of flow courses is an evacuation slot;

rotating the drill string to cause the drill bit to penetrate and cut through the formation, creating a wellbore;

using the first cutting element of the drill bit to form a core sample fragment proximate the bit centerline of the drill bit during rotation of the drill string, wherein the core sample fragment has a width based on the first radial position of the first cutting element;

using the angled surface of the coring blade to exert a lateral load on a side of the core sample fragment in order to cause the core sample fragment to break away from the formation after the core sample fragment reaches a length;

relaying the core sample fragment to the evacuation slot of the drill bit; and transporting the core sample fragment from the evacuation slot to a surface of the formation via an annulus formed between the wellbore and the drill string.

28. The method of claim 27, further comprising a step of:

in an event that the angled surface of the coring blade fails to break the core sample fragment away from the formation, using a conical insert disposed proximate the bit centerline of the drill bit to exert a central load on an end of the core sample fragment to break the core sample fragment away from the formation after the core sample fragment reaches the length, wherein a relief disposed between the substantially vertical surface and the angled surface and wherein the conical insert is embedded in the bit body such that an apex of the conical insert is positioned axially above the relief of the coring blade.

29. The method of claim 27, wherein the ratio of the length of the core sample fragment to the width of the core sample fragment is greater than or equal to one.

30. The method of claim 27, wherein the width of the core sample fragment is in a range of 0.05 times a diameter of the drill bit to 0.25 times the diameter of the drill bit, and wherein the length of the core sample fragment is in a range of 0.05 times the diameter of the drill bit to 0.25 times the diameter of the drill bit.

31. A method of obtaining a core sample fragment from a subterranean formation, the method comprising:

securing the drill bit according to claim 14 to a lower end of a drill string;

rotating the drill string to cause the drill bit to penetrate and cut through the formation, creating a wellbore;

using the conical cutting element embedded in the coring blade of the drill bit to score the formation as a core sample fragment is formed proximate the bit centerline of the drill bit during rotation of the drill string, wherein the core sample fragment has a width based on the first radial position of the conical cutting element embedded in the coring blade;

using the conical cutting element embedded in the coring blade to weaken the core sample fragment in order to cause the core sample fragment to break away from the formation after the core sample fragment reaches a length;

in an event that the conical cutting element embedded in the coring blade fails to break the core sample fragment away from the formation, using a conical insert disposed proximate the bit centerline of the drill bit to exert a central load on an end of the core sample fragment to break the core sample fragment away from the formation after the core sample fragment reaches the length, wherein the conical insert disposed proximate the bit centerline of the drill bit is embedded in the bit body such that an apex of the conical insert is positioned axially above the first radial position of the conical cutting element embedded in the coring blade;

relaying the core sample fragment to the evacuation slot of the drill bit; and transporting the core sample fragment from the evacuation slot to a surface of the formation via an annulus formed between the wellbore and the drill string.

32. The method of claim 31, wherein the ratio of the length of the core sample fragment to the width of the core sample fragment is greater than or equal to one.

33. The method of claim 31, wherein the width of the core sample fragment is in a range of 0.05 times a diameter of the drill bit to 0.25 times the diameter of the drill bit, and wherein the length of the core sample fragment is in a range of 0.05 times the diameter of the drill bit to 0.25 times the diameter of the drill bit.

34. The method of claim 31, wherein the conical cutting element is oriented such that the conical cutting element is at an angle ranging from greater than 0 to 45 degrees with respect to a line parallel to the bit centerline.

* * * * *